US007980921B2

(12) United States Patent
Saravanos

(10) Patent No.: US 7,980,921 B2
(45) Date of Patent: Jul. 19, 2011

(54) TILE CUTTING TOOL AND METHODS

(75) Inventor: Peter G. Saravanos, Framingham, MA (US)

(73) Assignee: Peter G. Saravanos, Framingham, MA (US)

( * ) Notice: Subject to any disclaimer, the term of this patent is extended or adjusted under 35 U.S.C. 154(b) by 416 days.

(21) Appl. No.: 11/726,240

(22) Filed: Mar. 21, 2007

(65) Prior Publication Data

US 2007/0283943 A1 Dec. 13, 2007

Related U.S. Application Data

(60) Provisional application No. 60/795,333, filed on Apr. 27, 2006, provisional application No. 60/784,908, filed on Mar. 21, 2006.

(51) Int. Cl.
*B24B 49/00* (2006.01)

(52) U.S. Cl. ..... 451/5; 125/23.01; 33/527

(58) Field of Classification Search ..... 33/527, 33/501.09, 501.17, 504, 552, 553, 557, 559, 33/560; 451/5; 125/23.01
See application file for complete search history.

(56) References Cited

U.S. PATENT DOCUMENTS

| | | | | |
|---|---|---|---|---|
| 241,241 | A | 5/1881 | Ruge | |
| 1,041,145 | A | 10/1912 | Moss | |
| 2,179,415 | A | 11/1939 | Mace | |
| D136,978 | S | 1/1944 | Tomasini | |
| 2,759,271 | A | 8/1956 | Von Duyke | |
| 2,840,914 | A | 7/1958 | Buckelew | |
| 2,949,674 | A | 8/1960 | Wexler | |
| 3,269,015 | A | 8/1966 | Barker | |
| 3,419,965 | A | 1/1969 | Madden | |
| 3,483,629 | A | 12/1969 | English | |
| 4,622,751 | A * | 11/1986 | Berg | 33/701 |
| 4,827,625 | A | 5/1989 | Le Moal | |
| 5,007,178 | A * | 4/1991 | Dewire et al. | 33/767 |
| 5,014,441 | A | 5/1991 | Pratt | |
| 5,546,668 | A | 8/1996 | Ahdoot | |
| 6,022,132 | A * | 2/2000 | Schulz | 700/186 |
| 6,112,424 | A * | 9/2000 | Friend | 33/527 |
| 6,195,904 | B1 * | 3/2001 | Greer | 33/527 |
| 6,481,112 | B1 * | 11/2002 | White | 33/527 |
| 2006/0037207 | A1 * | 2/2006 | Knight, Jr. | 33/526 |
| 2006/0062998 | A1 | 3/2006 | Taylor et al. | |

FOREIGN PATENT DOCUMENTS

| | | |
|---|---|---|
| DE | 203 04 786 | 7/2003 |
| EP | 1 207 029 A1 | 5/2002 |
| EP | 1 338 387 | 8/2003 |
| FR | 283 6647 | 9/2003 |
| GB | 2 379 709 | 3/2003 |

* cited by examiner

*Primary Examiner* — Robert Rose
(74) *Attorney, Agent, or Firm* — Sampson & Associates, P.C.

(57) ABSTRACT

A tool and method for marking dimensions for cutting a tile include a platform with a front wall defining an x axis, a side wall defining a y axis, with the y axis being perpendicular to the x axis, and a front guideline defining an x' axis parallel to the x axis. Also included are a plurality of telescopic fingers which are manually extendable, in parallel with the y axis, to releasably retained protracted positions. The platform is configured for superposed alignment with an installed tile adjacent to an area with an obstruction, and also for adjacent alignment with a loose tile to be cut. Distal ends of protracted fingers indicate points on the surface of the loose tile for marking guidemarks demarcating dimensions for cutting the loose tile.

38 Claims, 30 Drawing Sheets

TILE CUTTING TOOL AND METHODS

RELATED APPLICATIONS

This application claims priority, to U.S. Patent Application Ser. No. 60/795,333, entitled Multi-Angle Tile Measuring Device, filed on Apr. 27, 2006; and U.S. Patent Application Ser. No. 60/784,908, entitled Multi-Angle Tile Measuring Device, filed on Mar. 21, 2006.

BACKGROUND

1. Technical Field

This invention relates to measuring instruments, and more particularly to instruments for determining dimensions for cutting tiles.

2. Background Information

Throughout this application, various publications, patents and published patent applications are referred to by an identifying citation. The disclosures of the publications, patents and published patent applications referenced in this application are hereby incorporated by reference into the present disclosure.

When installing floor tiles, it is sometimes necessary to install a tile in an irregularly shaped area with an obstruction. A tile installer will typically mark out dimensions for cutting a tile to fit in the area. To determine the cutting dimensions, the installer may use a tape measure to make multiple length measurements of the area. A drawback to using measuring instruments such as tape measures, is that only one dimension is measured, such as length, without the context of a second dimension, such as the location of the length dimension in reference to the width of the area. Accurate measurements may therefore be difficult to make. As a result, tile installers typically cut an initial template tile for filling the area, and repeatedly refine the template until it fits in the area. This approach is time consuming and inefficient for professionals, and beyond the skill level of many amateur tile installers such as home owners.

Woodworking gauges, such as those used by carpenters for tracing contours of objects such as walls and moldings, may not be suitable for use in tile installation. The woodworking gauges tend to be relatively small, typically less than twelve inches, with rigid rods held in friction fit. The woodworking gauge is not designed to be anchored on a floor for making dimensional measurements of an area adjacent to the object. Instead, the woodworking gauges are designed to be pushed towards an object, so that the rods are forced into the contour of the object.

Therefore, a need exists for a two dimensional measuring instrument for measuring dimensions for cutting a tile.

SUMMARY

In one aspect of the invention, a tool for determining dimensions for cutting a tile includes a body with a platform. The platform has a planar top face, a front wall defining an x axis, and a side wall defining a y axis, with the y axis being perpendicular to the x axis. The platform includes a front guideline disposed on the top face which defines an x' axis, which is parallel to the x axis.

In this aspect of the invention, the body includes a plurality of individually extendable telescopic fingers with distal ends. Each finger is manually extendable, in parallel with the y axis, to a protracted position. The protracted position may be releasably retained until the finger is manually collapsed back to a contracted position.

In this aspect, the platform is configured for secured placement on an installed tile with a side edge and an open edge adjacent to an area with an obstruction, wherein the front guideline is positioned in superposed alignment with the open edge, and the side wall is positioned in superposed alignment with the side edge. A selection of two or more fingers of the plurality of fingers may be extended to protracted positions in which the distal end of each selected finger is engaged with the obstruction.

In this aspect of the invention, the platform is also configured for removal from the installed tile and for placement adjacent to a loose tile to be cut, wherein the front wall is placed along a first edge of the loose tile, the platform side wall is positioned in alignment with a second edge of the loose tile, and the fingers of the selection are projected over the loose tile, and wherein the distal ends of the fingers of the selection define dimensions for cutting the loose tile.

In another aspect of the invention, the body includes a computing element with a processor and a memory storage component. The computing element is configured to store and retrieve data relating to configurations of x and y coordinates of the fingers. This aspect also includes a user interface configured for user control of the computing element.

In another aspect of this invention, a method for determining dimensions for cutting a tile includes securely positioning an embodiment of the tool on an installed tile, wherein the front wall is placed on superposed alignment with an open edge of the installed tile, and the side wall is placed in superposed alignment with a side edge of the installed tile. This aspect also includes extending two or more fingers from the plurality of fingers to protracted positions, wherein the distal end of each protracted finger engages the obstruction.

This aspect further includes removing the tool from the installed tile; and placing the tool adjacent to a loose tile, wherein the front wall is placed along a first edge of the loose tile, and the side wall is positioned in alignment with a second edge of the loose tile.

In yet another aspect of this invention, a method of manufacturing a tool for determining dimensions for cutting a tile includes forming a body with a platform, the platform having a planar top face, a front wall defining an x axis, and a side wall defining a y axis, with the y axis being perpendicular to the x axis. This aspect also includes disposing a front guideline on the top face, the front guideline extending along an x' axis, the x' axis being parallel to the x axis.

This aspect further includes disposing on the body a plurality of individually extendable telescopic fingers; and configuring each finger of the plurality to be manually extendable, in parallel with the y axis, to a protracted position, the protracted position being releasably retained until the finger is manually collapsed to a contracted position.

This method further includes configuring the platform for secured placement on an installed tile with a side edge and an open edge adjacent to an area with an obstruction, wherein the front guideline is positioned in superposed alignment with the open edge, and the side wall is positioned in superposed alignment with the side edge. This method also includes further configuring the platform for removal from the installed tile; and further configuring the platform for placement adjacent to a loose tile to be cut, wherein the front wall is placed along a first edge of the loose tile, the platform side wall is positioned in alignment with a second edge of the loose tile, and fingers in protracted position are projected over the loose tile, wherein the distal ends of the protracted fingers define dimensions for cutting the loose tile.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1A:
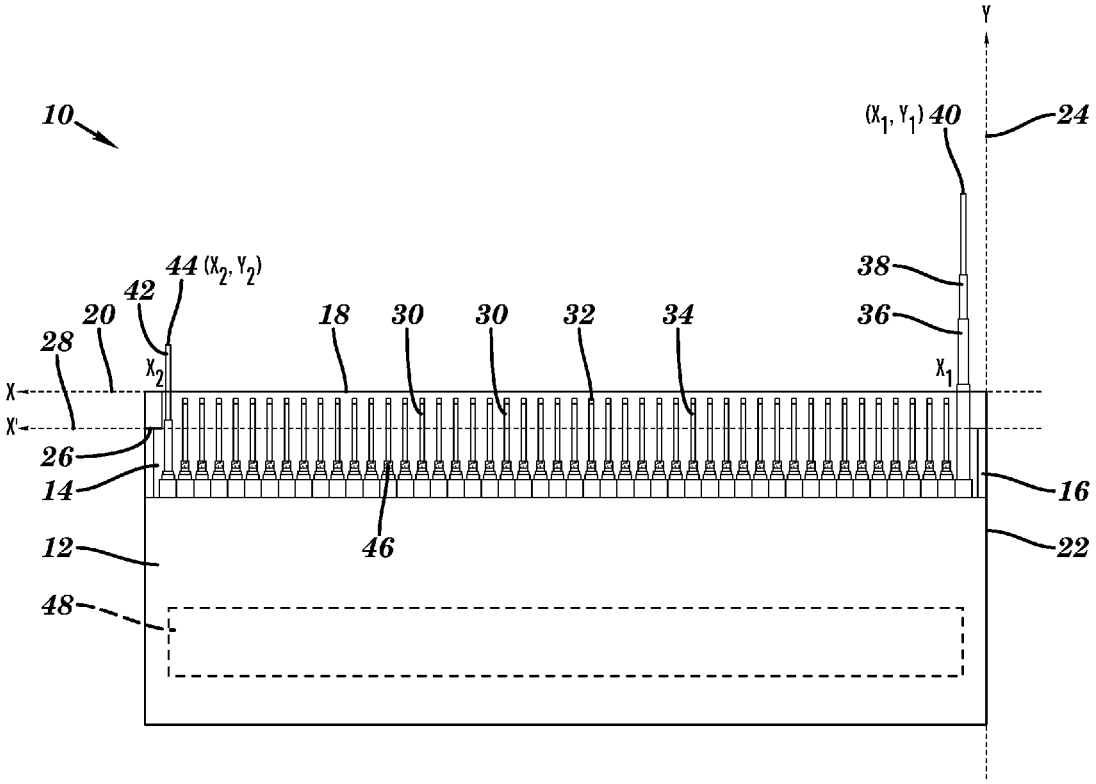
FIG. 1A is a plan view of an embodiment of the invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

Embodiments of the present invention provide a relatively compact tool that may be used to quickly and easily generate a profile along which a tile may be cut to precisely fit within a space which is at least partially obstructed by a post, wall, or other architectural element. These embodiments may be used by simply placing the tool on a pre-installed tile located adjacent the partially obstructed space, and then extending the fingers until they engage the obstruction. The tool may then be placed alongside a loose tile to be cut, with the fingers extending across the surface of the tile. The tile may then simply be marked at the tips of the extended fingers to define the profile along which the tile is to be cut.

Embodiments of the present invention include a computing element configured for digital storage of measurements in a memory component. In some embodiments, the measurements may be retrieved and displayed on a display disposed on the body. The memory component of some embodiments may be coupled to a cutting tool.

Embodiments of the present invention provide an intuitive method for measuring and marking a loose tile to be cut. By allowing the user to align the tool with the tile to be cut, rather than requiring a user to keep track of mathematical calculations, the user is able to save time and effort. These embodiments therefore make tile installation more accessible for amateur tile installers, such as homeowners.

Embodiments of the present invention further provide a relatively inexpensive method of manufacturing a tool for determining dimensions for cutting a tile.

In the embodiment of FIG. 1A, tool 10 includes a body 12 with a platform 14. The platform side wall 22 defines a Y Axis 24, and the platform 14 front wall 18 defines an X Axis 20. Disposed on the top face 16 of platform 14 is a front guideline 28 which defines an X' Axis, which is parallel to the X Axis.

Tool 10 includes a plurality of telescopic fingers 30 with distal ends 32. Each finger 30 is located at an x coordinate corresponding to a location along the X Axis 20, with the distal ends 32 positioned at a y coordinate corresponding to a location along the Y Axis 24.

Each of the fingers 30 is manually extendable to a protracted position 36, in which the distal end 32 is repositioned at a new y coordinate. The protracted position 36 is retained until the finger 32 is manually collapsed back to a contracted position 34. An optional digitally engagable knob 46 disposed in the proximity of distal end 32 may be used to pull a finger 30 to a protracted position 36 and to push finger 30 back to a contracted position 34. In contrast, the rigid rods of the aforementioned woodworking gauges are not designed to be individually extended to protracted positions. The rods may be prone to breakage if used in this manner.

In the embodiment of FIG. 1A, finger 38 at x coordinate x1 is shown in a protracted position 36 at y coordinate y1, at point (x1, y1) 40. Finger 42 is shown in protracted position 36 at point (x2, y2) 44. Advantageously, only two fingers need to be extended in order to measure an obstruction which forms a straight line across the open area, as discussed below in reference to FIGS. 2 and 3. In contrast, all of the rods of the aforementioned woodworking gauges are typically pushed into the contour of an object.

Figure 1B:
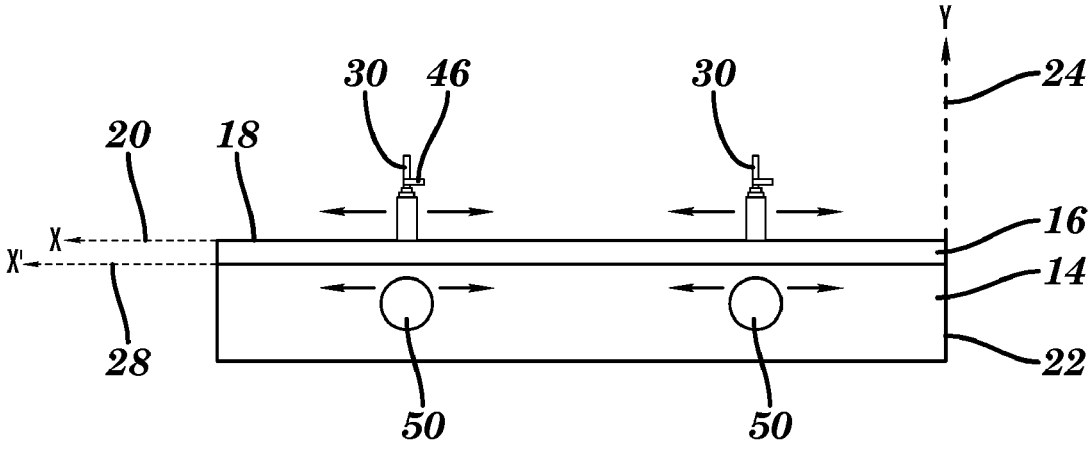
FIG. 1B is a plan view of alternate embodiment of the invention.

The embodiment of FIG. 1B, which contains two fingers 30, may be used with such straight line obstructions. In the embodiment of FIG. 1B, the fingers 30 may be slidably moved in parallel with the X Axis 20 to adjusted X coordinate positions. The adjusted X coordinate positions are releasably retained, for example in a friction fit. Slider knobs 50 are configured for manual sliding of the fingers to adjusted X positions.

Figure 2:
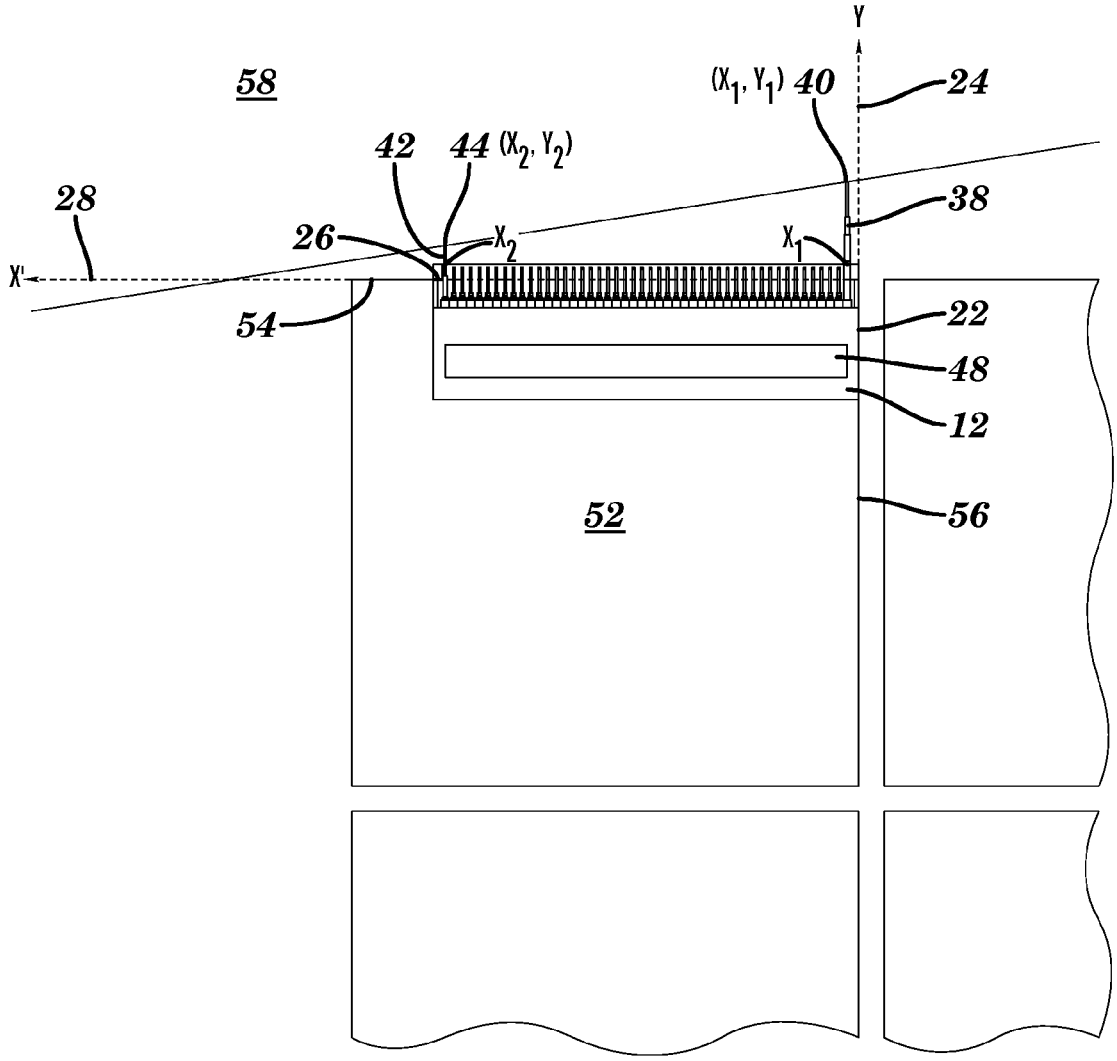
FIGS. 2-3B are plan views of the embodiment of FIG. 1A in an operative position.

Tool 10 of FIG. 1A is configured to be securely placed on an installed tile next to an open area with an obstruction, as shown in the embodiment of FIG. 2. In contrast, the aforementioned woodworking gauges are not configured to be secured on a surface, but instead are configured to be moved toward an object. Front guideline 28 of tool 10 is configured to be positioned in superposed alignment with open edge 54 of installed tile 52, the open edge 54 being adjacent to the area with the obstruction 58. Side wall 22 is configured to be positioned in superposed alignment with side edge 56 of installed tile 52. As a result, open edge 54 is aligned along the X' Axis 28, and the side edge 56 is aligned along the Y Axis 24.

As shown in the embodiment of FIG. 2, fingers 38 and 44 are in protracted positions 36, with distal ends 32 of fingers 38, 44, in engagement with the obstruction 58. Finger 38 at x1 is extended to point (x1, y1) 40, and finger 42 at x2 is extended to point (x2, y2) 44.

Figure 3A:
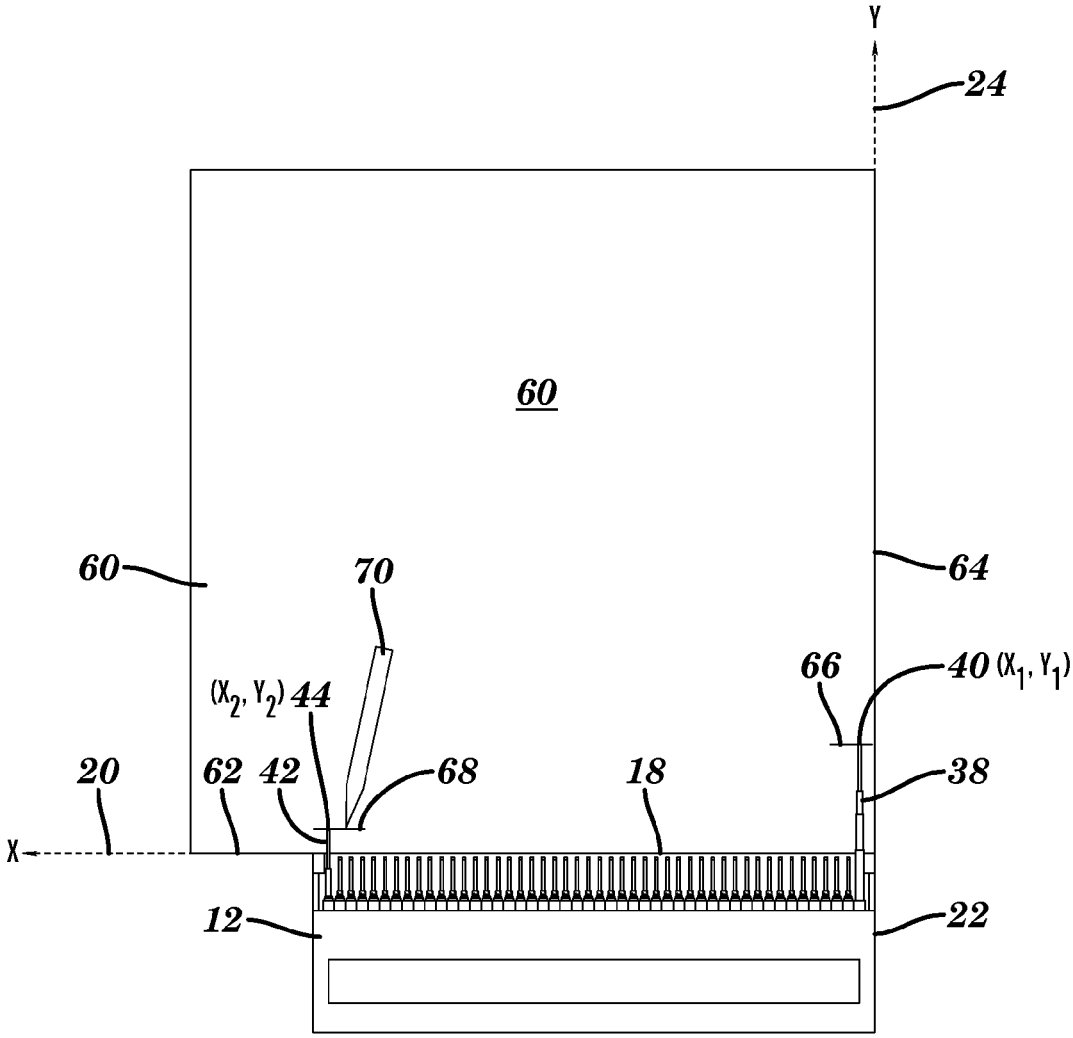
Figure 3B:
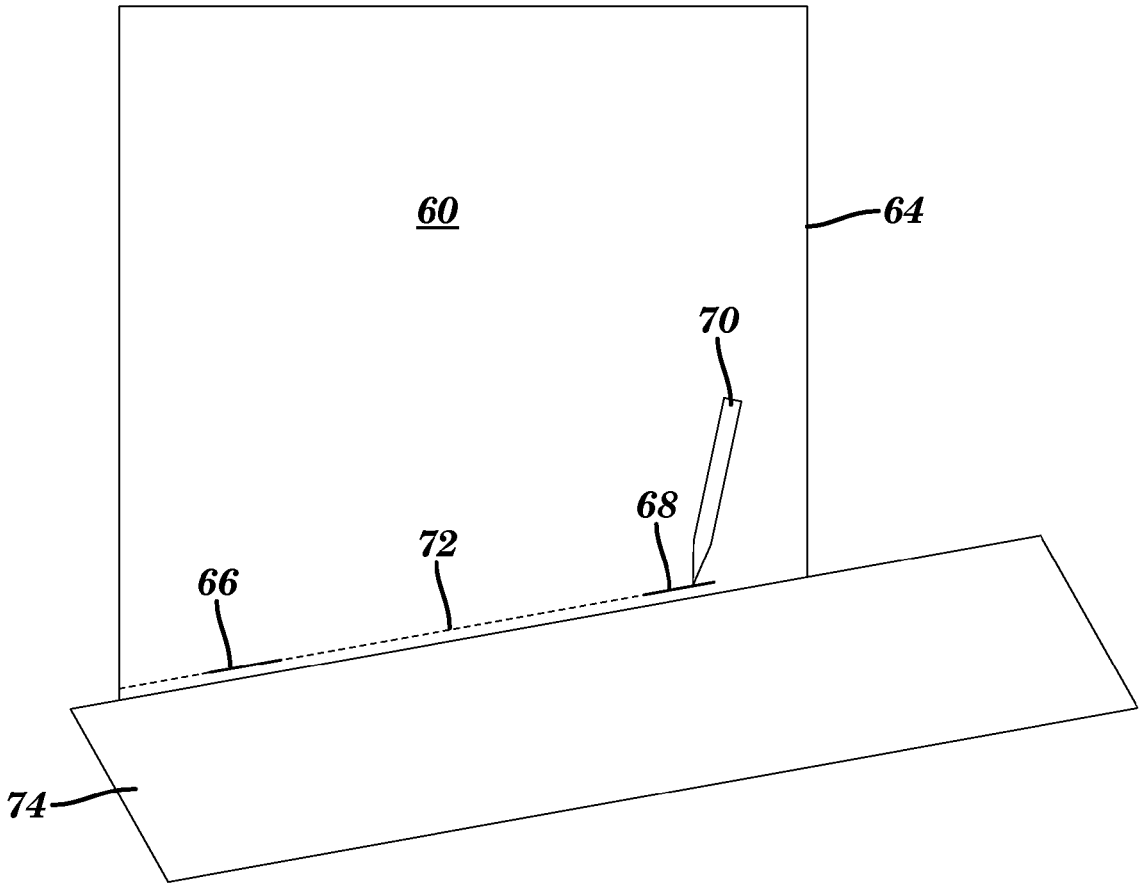

The embodiment of FIGS. 3A-3B is configured to be placed adjacent to a loose tile to be cut, with fingers in protracted position projected over the loose tile, as shown in FIG. 3A. Front wall 18 is configured to be placed along first edge 62 of loose tile 60, and side wall 22 is configured to be positioned in alignment with second edge 64 of tile 60. First edge 62 is thereby aligned along the X Axis 20, and second edge 64 is aligned along Y Axis 24. As a result, the surface of tile 60 corresponds to the plane defined by the X Axis 20 and Y Axis 24, and points on the surface of tile 60 correspond to points defined by x and y coordinates.

In the embodiment of FIG. 3A, finger 38 is projected over the top surface of tile 60, with its distal end positioned at point 40, at which a first guidemark 66 may be marked with a marking implement 70. Finger 42 is projected over the surface of tile 60, with its distal end positioned at point 44, at which a second guidemark 68 may also be marked with marking implement 70.

As shown in the embodiment of FIG. 3B, guidemarks 66, 68, define a notional profile line 72 for cutting the tile 60. In this example, profile line 72 is a straight line connecting guidemarks 66, 68, which may be drawn with a straight edge 74 and marking instrument 70. In other examples, profile line 72 may form substantially any profile, and may include straight lines, curved lines, and combinations thereof, as discussed in more detail below.

Figure 4A:
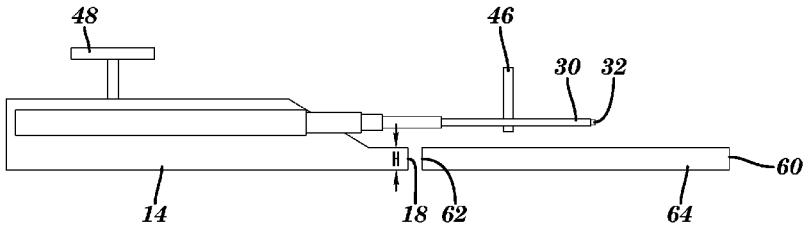
FIG. 4A is an elevational view of the embodiment of FIG. 1A.
Figure 4B:
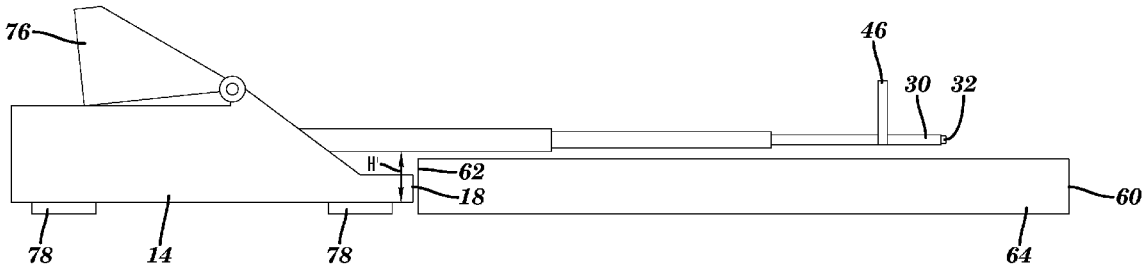
FIG. 4B is an elevational view of an alternate embodiment.

As shown in the embodiment of FIG. 4A, platform 14 should have sufficient height H to allow fingers 30 to project over the surface of adjacent loose tile 60. This is an improvement over the aforementioned woodworking gauges, which are not designed for projecting rods over adjacent items such as tiles. As shown in the alternate embodiment of FIG. 4B, finger 30 is projected over the platform 14 at a sufficient height H' for the finger to clear the surface of loose tile 60. The embodiment of FIG. 4B includes a housing with a hinged cover 76, which may be closed over finger 32 in retracted position 34. The embodiment of FIG. 4B also includes anchoring pads 78, which are configured to releasably secure platform 14 to a surface, such as a surface of an installed tile. For example, anchoring pads 78 may be rubber pads.

Figure 5A:
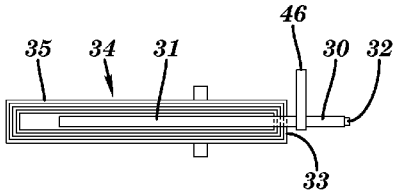
FIGS. 5A-5B are elevational views of a portion of the embodiment of FIG. 1A.
Figure 5B:
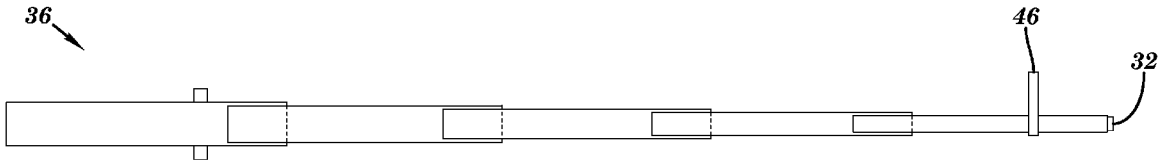

As shown in the embodiment of FIGS. 5A-5B, telescoping finger 30 may be constructed of a series of slidable concentric hollow tubes 31 with necks 33, disposed within outer casing 35. In contracted position 34 (FIG. 1A), the hollow tubes 31 are slidably collapsed, with tubes 31 concentrically disposed within the outer casing 35, as shown in FIG. 5A. In protracted position 36, the tubes 31 are slidably extended from casing 35, as shown in FIG. 5B. The protracted position 36 may be retained in a friction fit, in which necks 33 provide a clamping action on internal tubes 31. The friction fit may be loose enough to be released by collapsing (e.g., pushing) the finger 32 back to contracted position 34. Optional knob 46 disposed in the proximity of the distal end 32 of the most interior tube 31 is configured for manually pulling the finger 30 to protracted position 36, and for manually pushing finger 30 to contracted position 34.

Figure 5C:
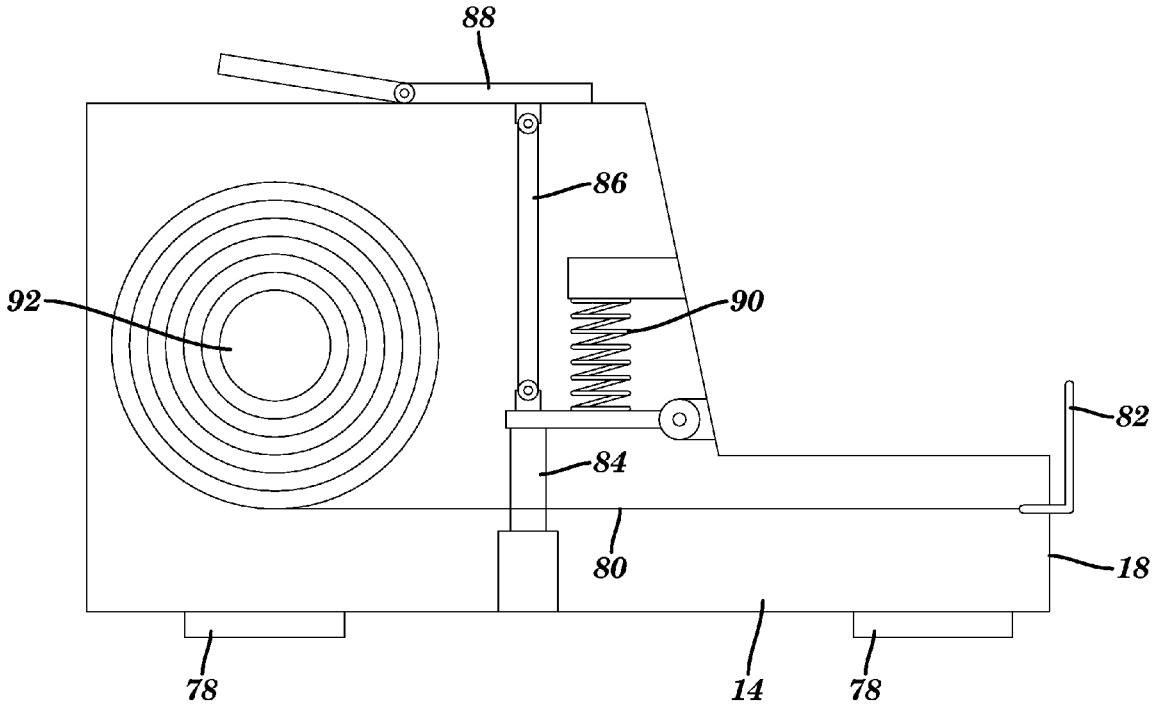
FIG. 5C is an elevational schematic view with portions broken away, of an alternate embodiment.

As shown in the alternative embodiment of FIG. 5C, an extendable measuring strip 80 may be disposed about reel 92. For example, the measuring strip 80 may be a tape measure. The measuring strip 80 may be manually extended with tab 82 to a protracted position, and fixed in the protracted position with stop 84, held by spring loaded lever 86, 90. Stop 84 may be manually controlled with switch 88.

Figure 6A:
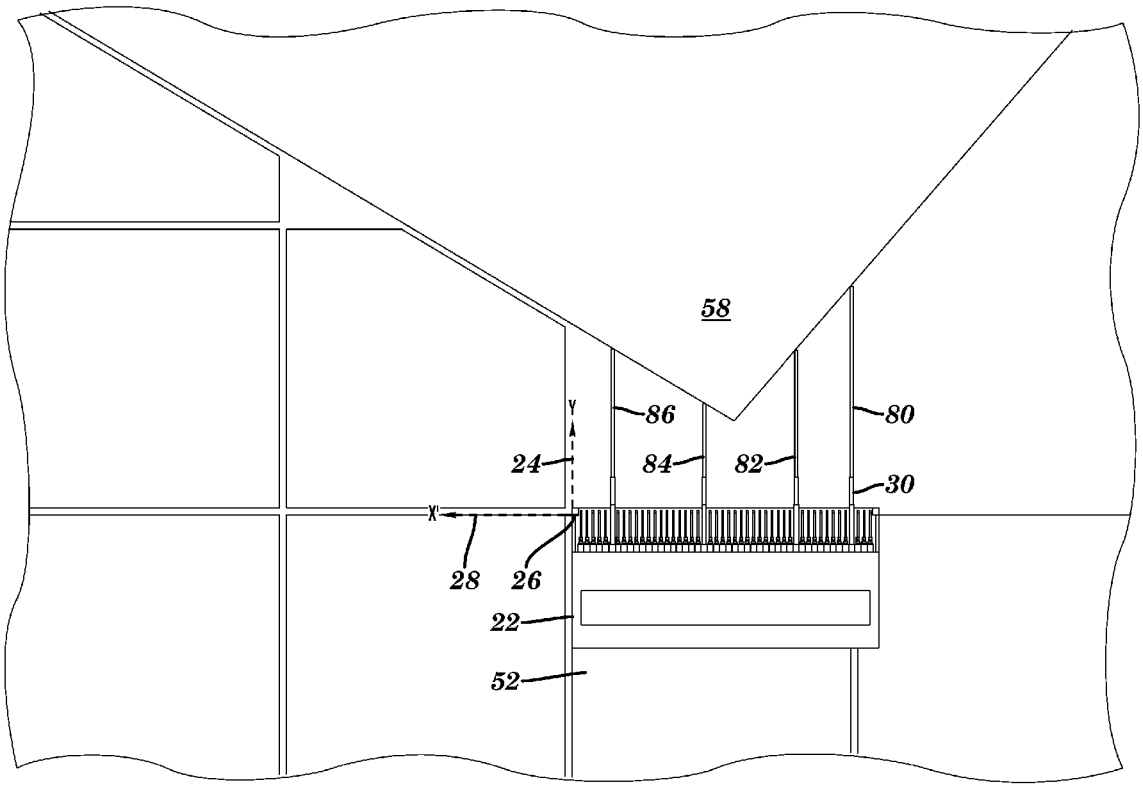
FIGS. 6A and 6C are plan views of the embodiment of FIG. 1A in an alternate operative position.
Figure 6B:
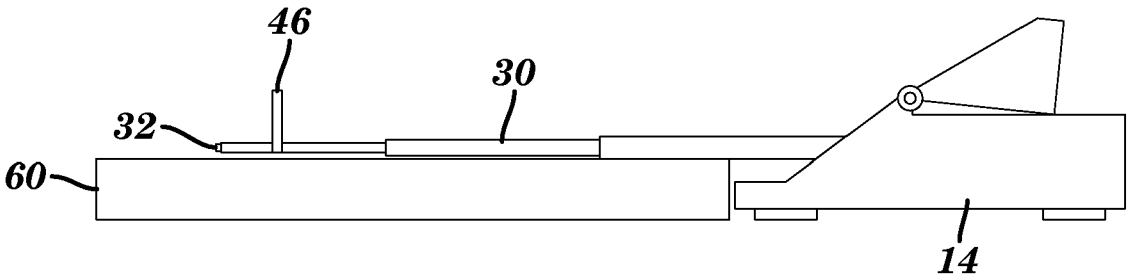
FIG. 6B is an elevational view of the embodiment of FIGS. 6A, 6C.
Figure 6C:
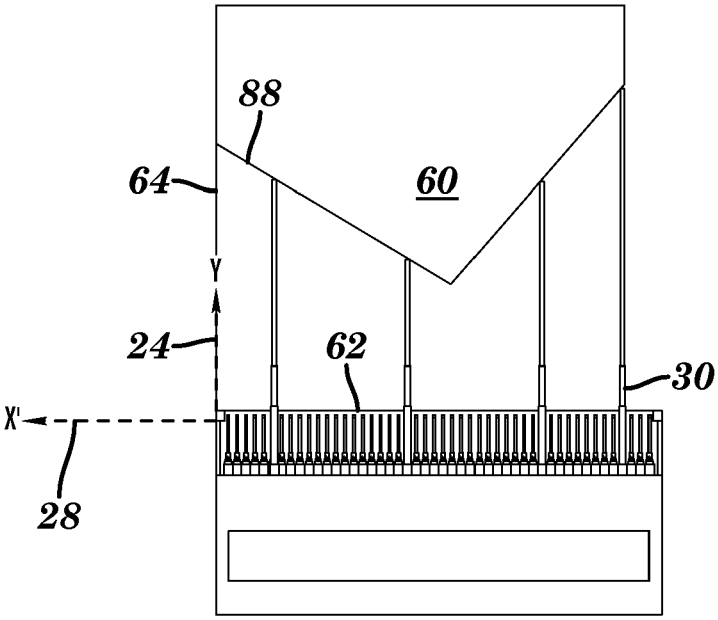

The embodiment of FIGS. 6A-6C is shown in use with more than one finger in protracted position. In this embodiment, side wall 22 defines Y Axis 24, and front guideline 26 defines X' Axis 28. Fingers 80, 82, 84, and 86 are shown in protracted positions in engagement with obstruction 58 in FIG. 6A. As shown in FIGS. 6B-6C, the fingers 80, 82, 84, and 86 are projected over the surface of adjacent loose tile 60, defining cutting line 88.

Figure 7A:
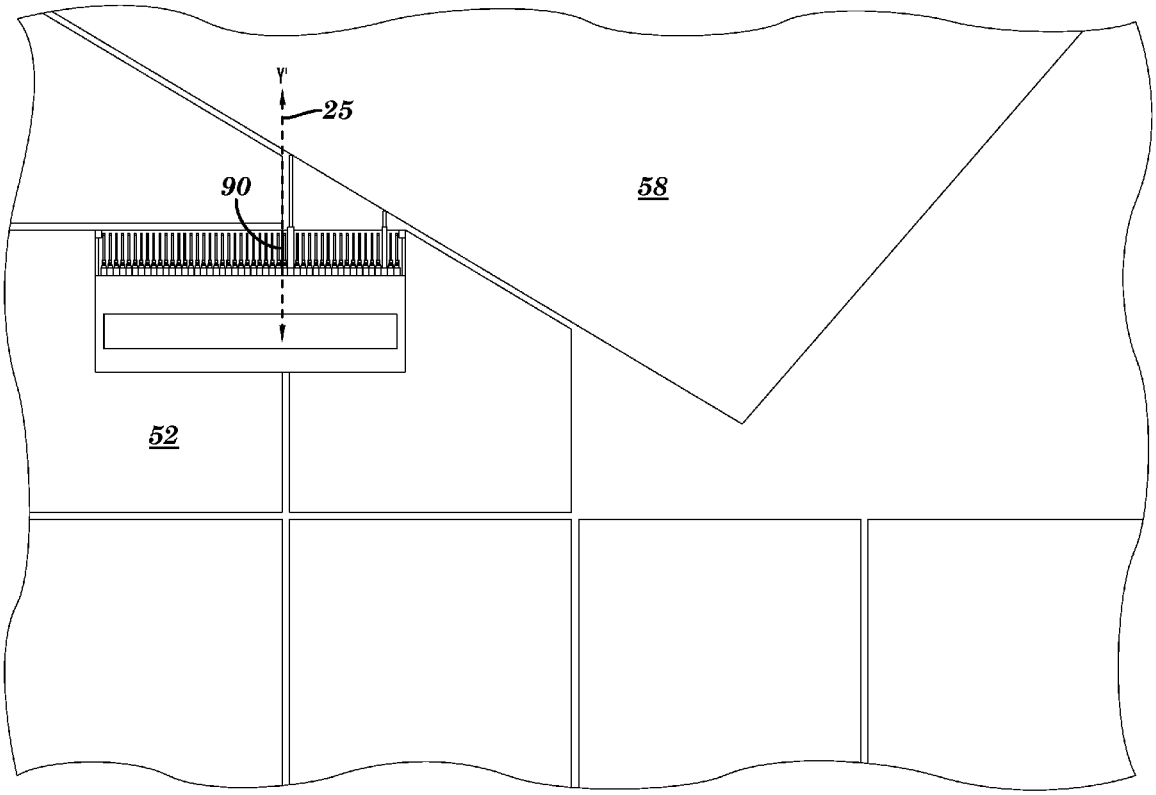
FIG. 7A is a plan view of an alternate embodiment in an operative position.
Figure 7B:
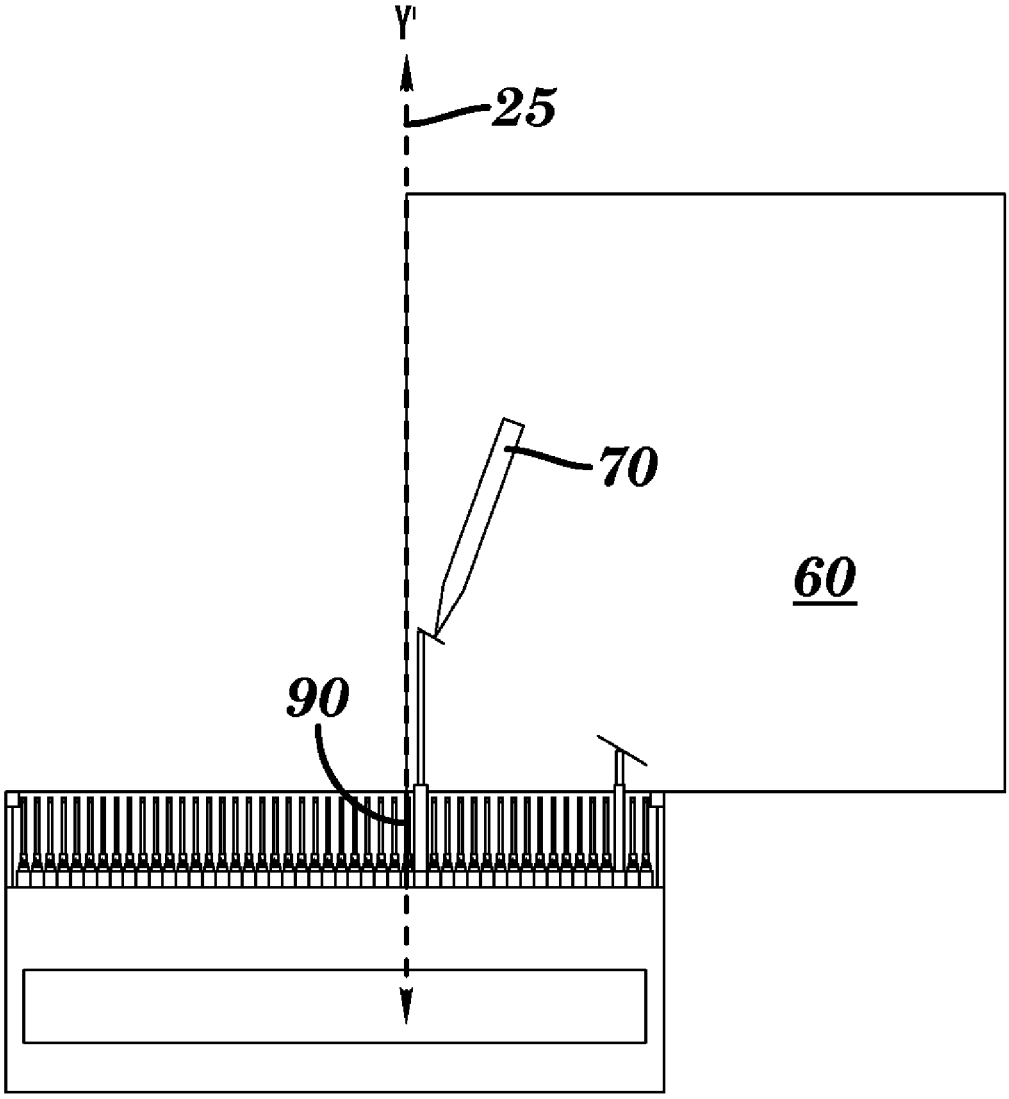
FIG. 7B is an elevational view of the embodiment of FIG. 7A.

In some applications, an area with an obstruction may not provide sufficient clearance to define a Y axis 24 with side wall 22. For example, as shown in the embodiment of FIGS. 7A-7B, an alternate Y' Axis 25 may be defined by a selected side guideline from plurality of side guidelines 90 disposed on the top face of the platform 14. The side guidelines 90 extend in parallel to the Y Axis 24, so that the alternate Y' Axes 25 are parallel to the Y Axis 24. As shown in FIG. 7B, the selected guideline 90 may be positioned in alignment with a second edge 64 of a loose tile 60, so that the second edge 64 is aligned along the Y' Axis 25.

Figure 8:
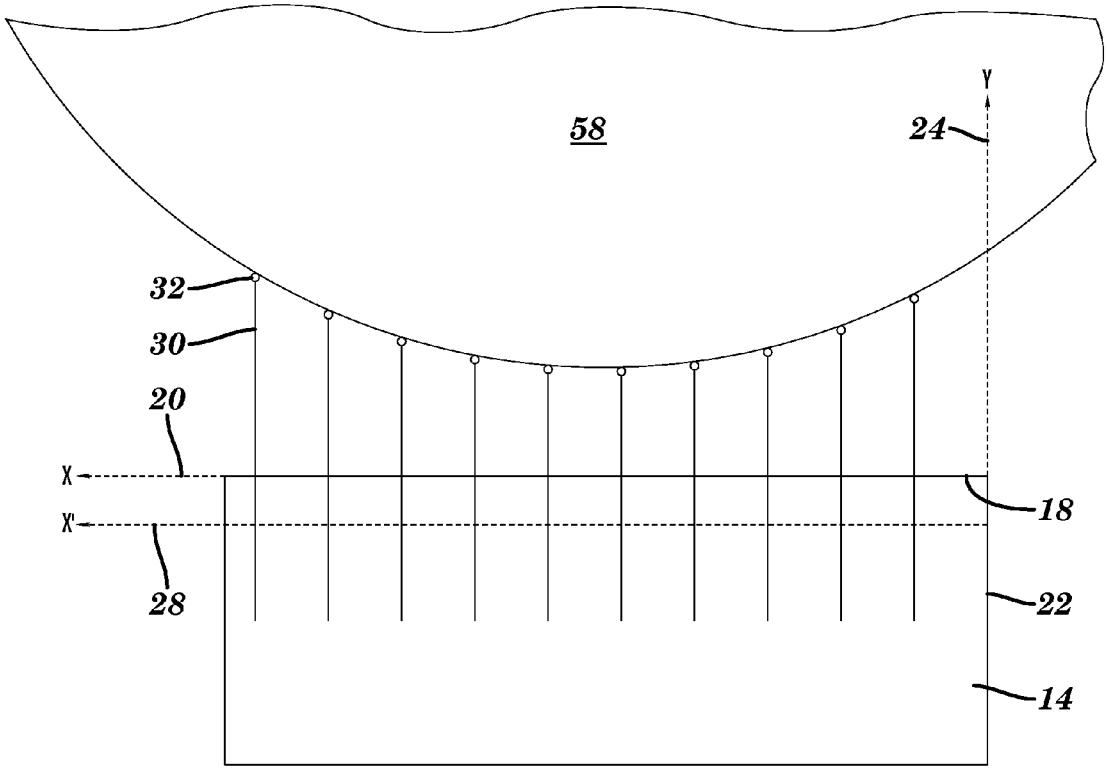
FIGS. 8 and 9 are schematic plan views an alternate embodiment in an operative position.
Figure 9:
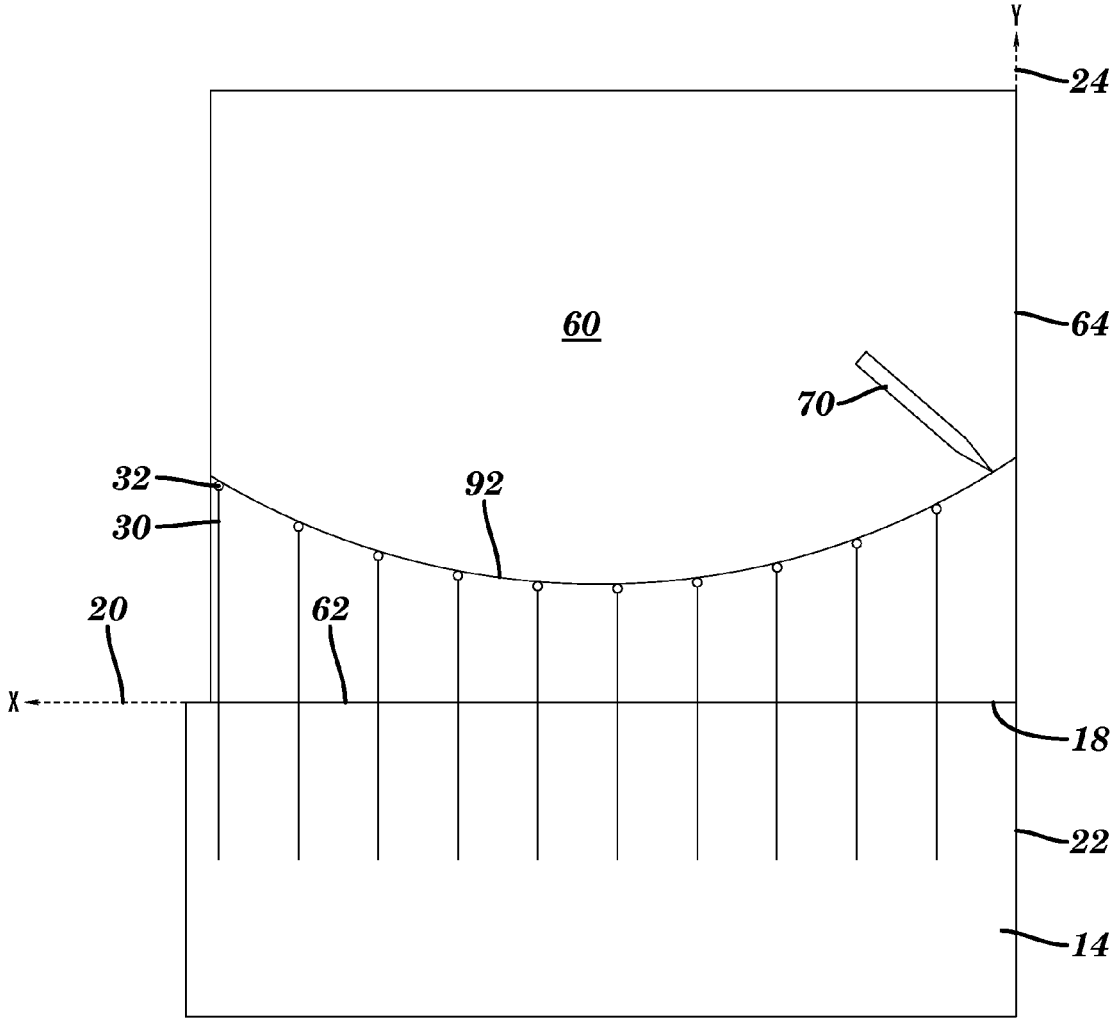

In the embodiment of FIGS. 8 and 9, multiple fingers 30 may be extended to obstruction 58, as shown in FIG. 8. The distal ends of these fingers 30 trace the contour of obstruction 58. When the platform 14 is placed adjacent to loose tile 60, as shown in FIG. 9, the distal ends of extended fingers 30 delineate the profile of the obstruction 58. A notional profile line 92 may be traced on the surface of loose tile 60 with marking implement 70.

Figure 10:
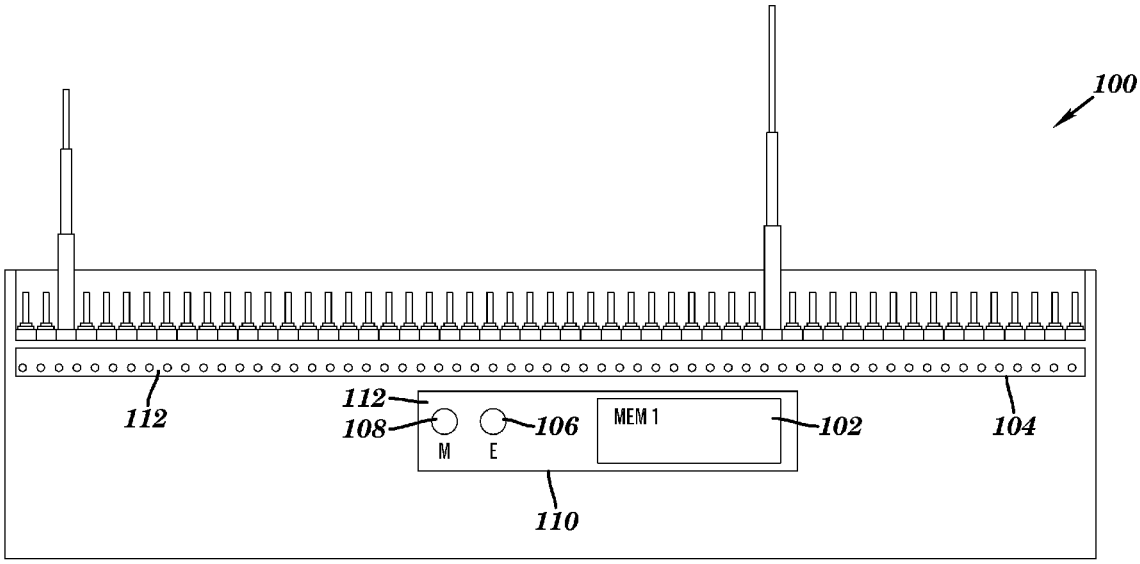
FIG. 10 is a plan view of an alternate embodiment in an operative position.

The embodiment of FIG. 10 includes a computing element 110 with a processor and a memory component. The computing element 110 is configured to store and retrieve configurations of x and y coordinates of the fingers. An optional user interface 112 may include a display screen 102. For example, the display 102 may indicate a particular configuration such as "MEM 1" which may be stored or retrieved from memory. Optional entry button 106 may be used to store configurations in memory, and optional retrieval button 108 may be used to retrieve configurations from memory. Optional coordinate display 104 may be used to display the coordinates of the fingers 30. For example, display 104 may be used to display the y coordinates for each finger, as shown. In this example, the y coordinates of fingers in contracted positions are calibrated at zero.

As further options, the fingers may be motorized, so that they may automatically return to set points stored in memory. In addition, the computing element 110 may be communicably coupled, e.g., by wire or wirelessly, to an automated computer controlled tile cutting machine, such as a cutting machine controlled in a manner similar to conventional CNC (Computer Numerical Control) milling machines.

Figure 11:
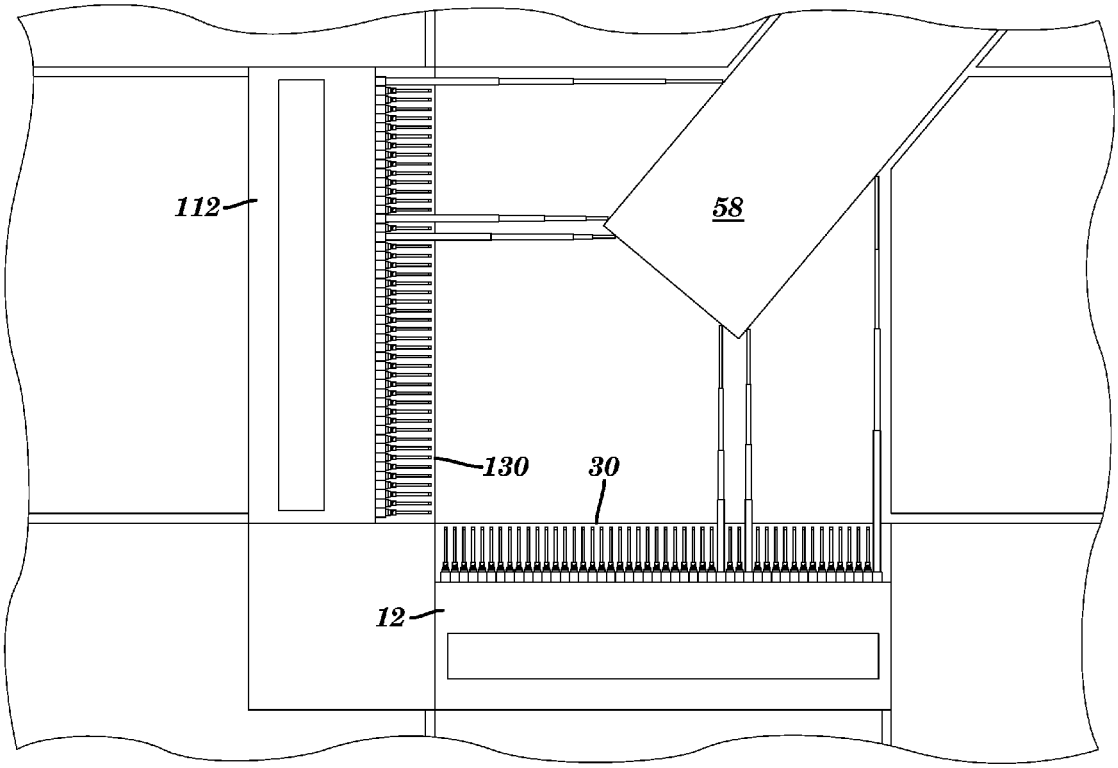
FIGS. 11 and 12 are plan views of an alternate embodiment in an operative position.
Figure 12:
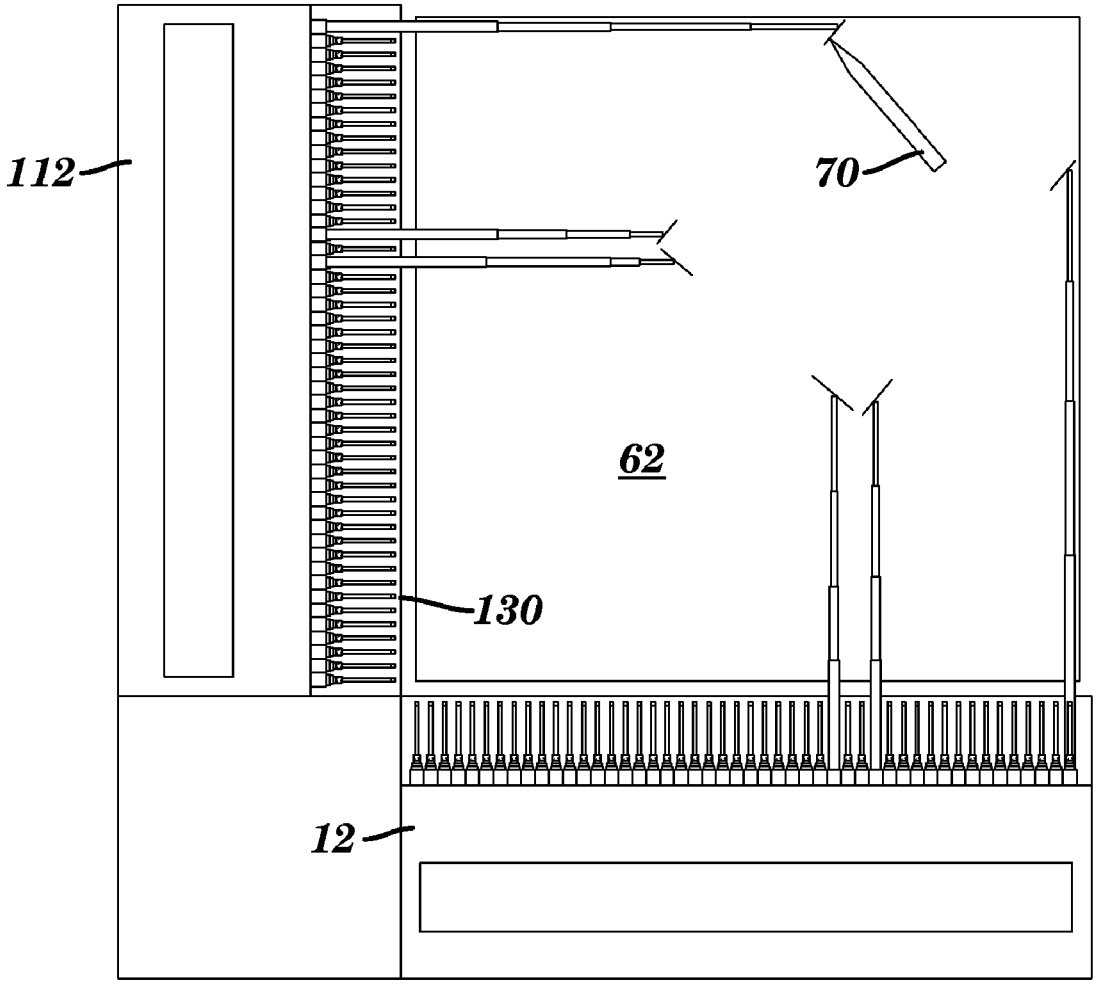
Figure 14:
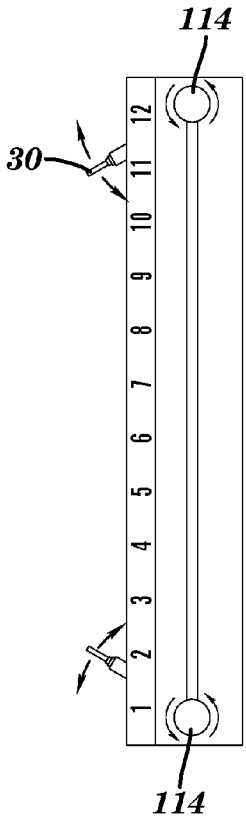
FIGS. 13 and 14 are plan views of an alternate embodiment.
Figure 13:
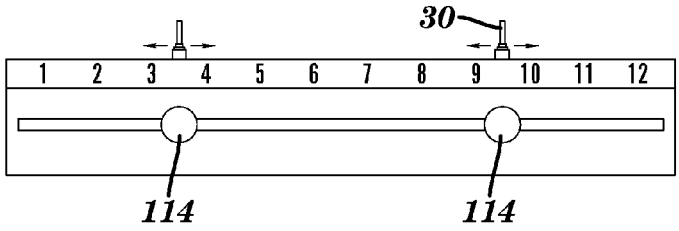
Figure 15:
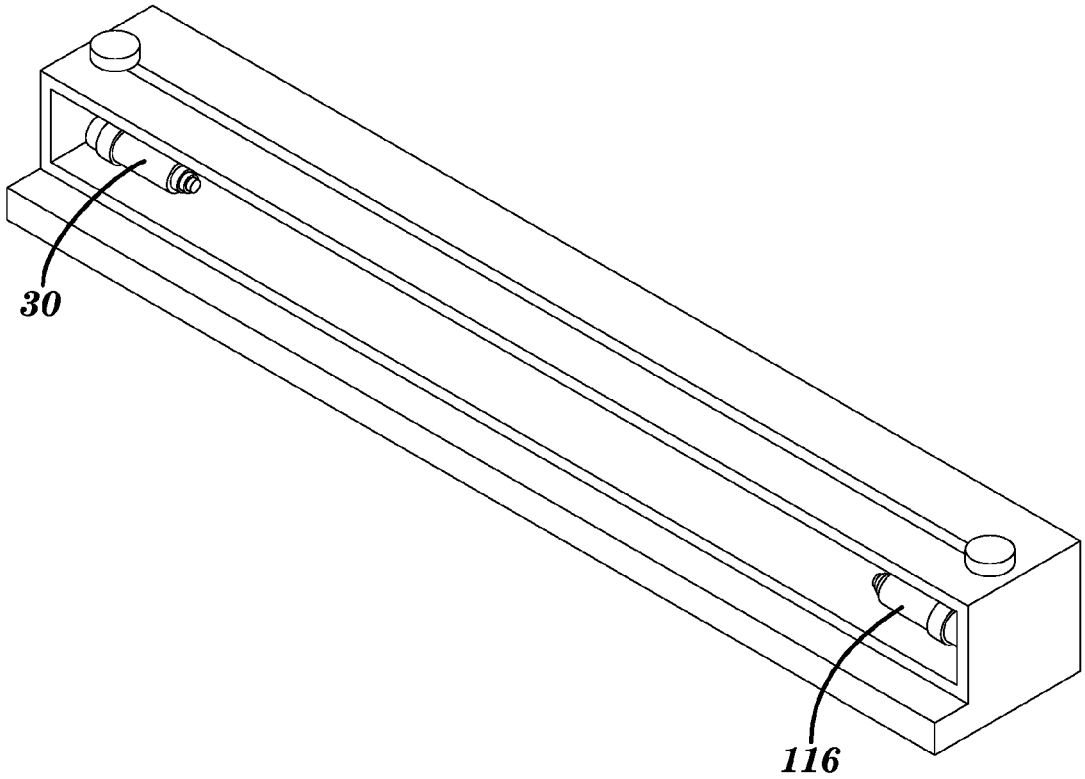
FIG. 15 is a perspective view of the embodiment of FIGS. 13 and 14.

As shown in relation to the embodiment of FIGS. 11 and 12, an additional body 112 may be disposed orthogonally to body 12, with fingers 130 extending in parallel with the X axis. This embodiment is particularly useful in measuring area with an obstruction with edges located at more than one y coordinate per x coordinate, such as obstruction 58.

Figure 17:
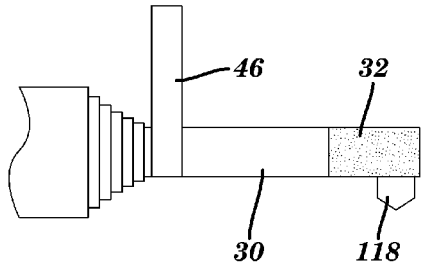
FIG. 17 is an elevational view of a portion of an alternate embodiment.
Figure 16:
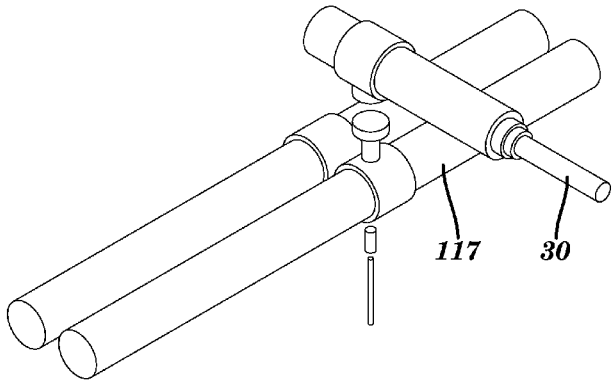
FIG. 16 is a perspective view of a portion of the embodiment of FIGS. 13 and 14.

As shown in the embodiment of FIGS. 13-16, dials 114 may be used to manually rotate fingers 30 to a retracted position 116, about a Z Axis which is orthogonal to both the X and Y Axes. This rotation may be used to effectively fold the tool to a relatively compact form factor when not in use, such as for convenient carrying within a user's pocket or tool box. The dials 114 may also be used to manually slide fingers 30 along track 117 in parallel with the X Axis to adjusted x coordinate positions. (FIG. 16). As shown in the embodiment of FIG. 17, the distal end 32 may include a marking implement 118 which may be used to mark the surface of the loose tile.

Figure 18A:
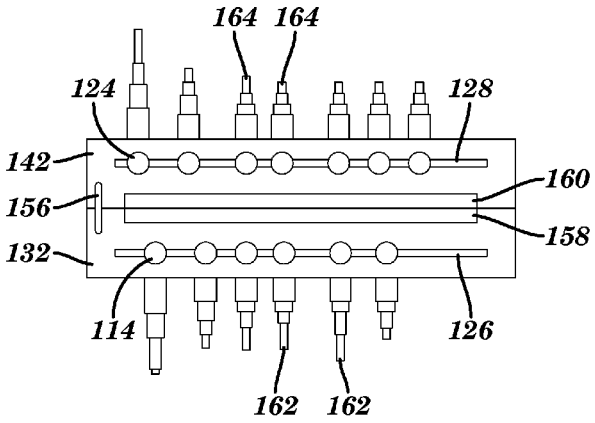
FIG. 18A is a plan view of an alternate embodiment.
Figure 18B:
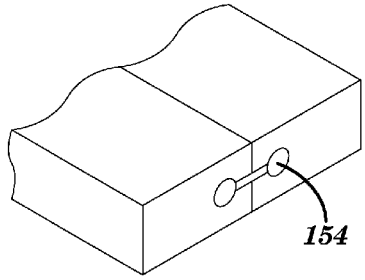
FIG. 18B is a perspective view of a portion of the embodiment of FIG. 18A.
Figure 18C:
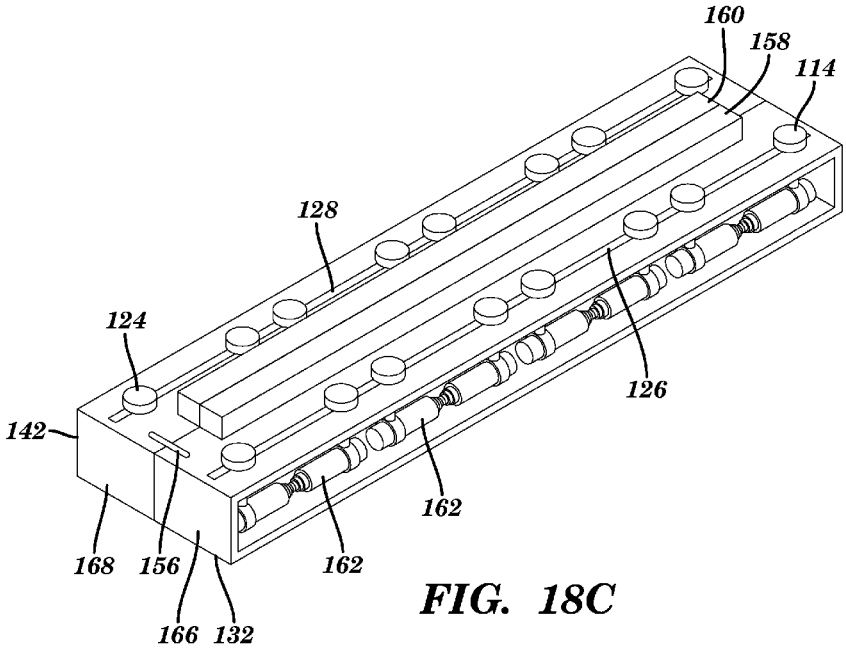
FIG. 18C is a perspective view of the embodiment of FIG. 18A.
Figure 18D:
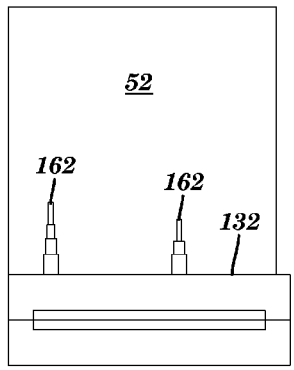
FIG. 18D is an elevational view of the embodiment of FIG. 18A.
Figure 18E:
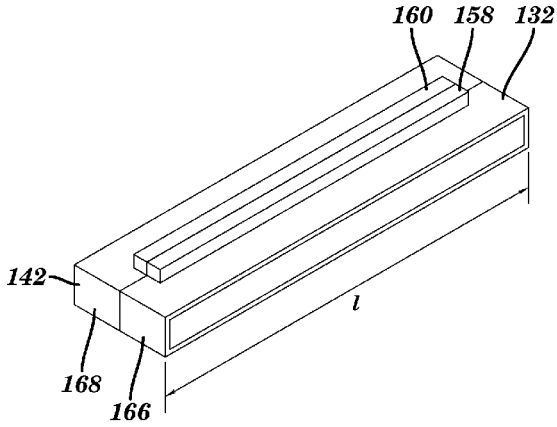
FIGS. 18E-18K are perspective views of the embodiment of FIG. 18A.
Figure 18F:
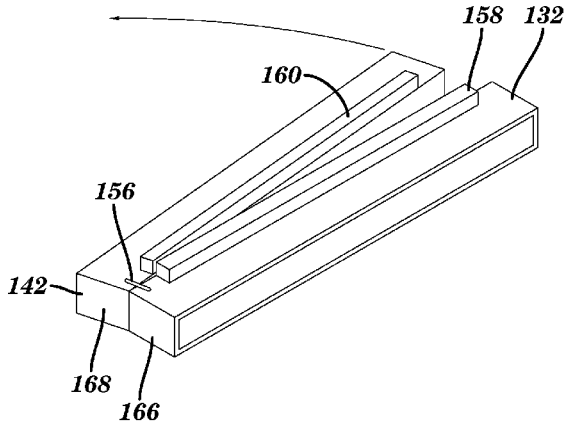
Figure 18G:
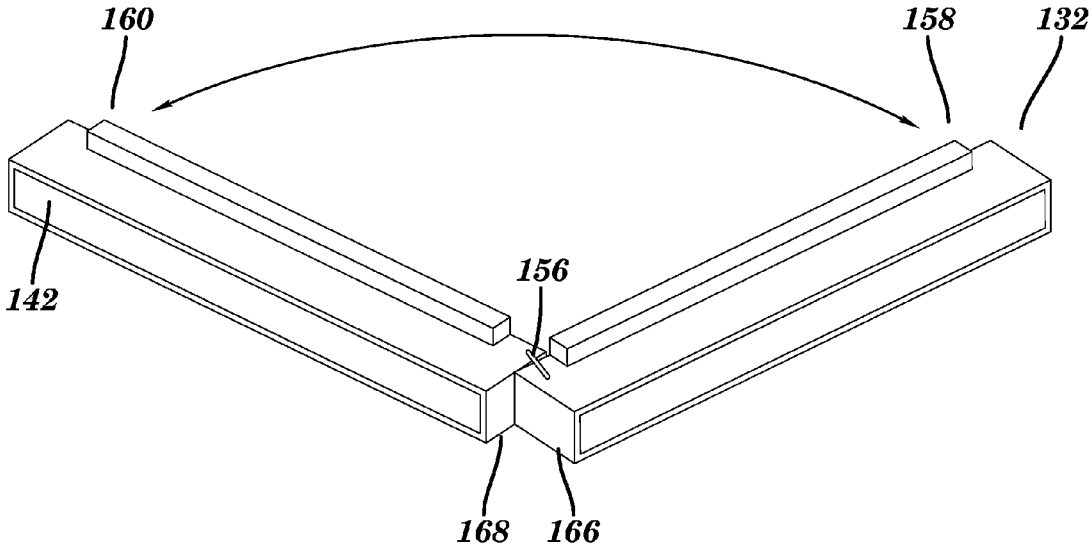
Figure 18H:
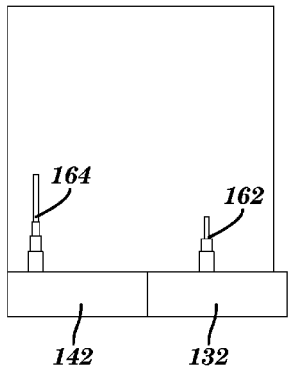
Figure 18I:
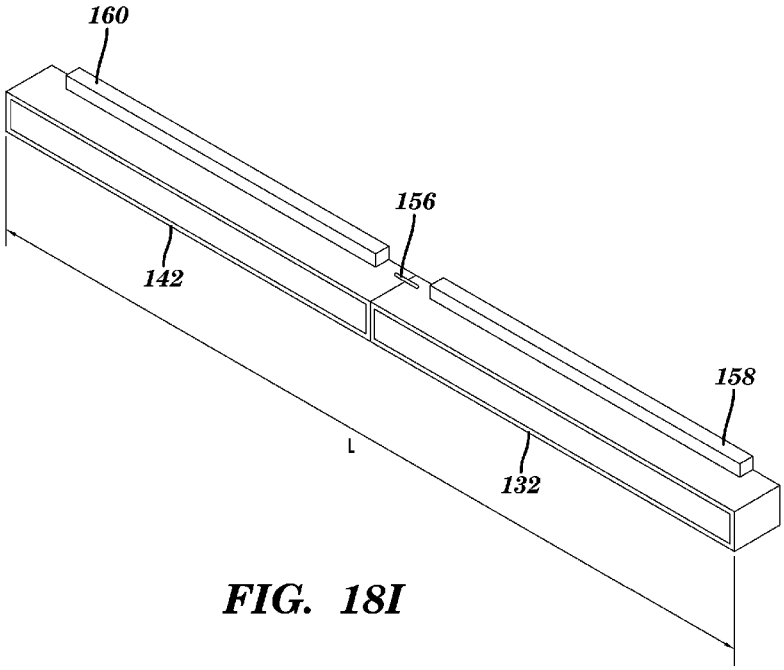
Figure 18J:
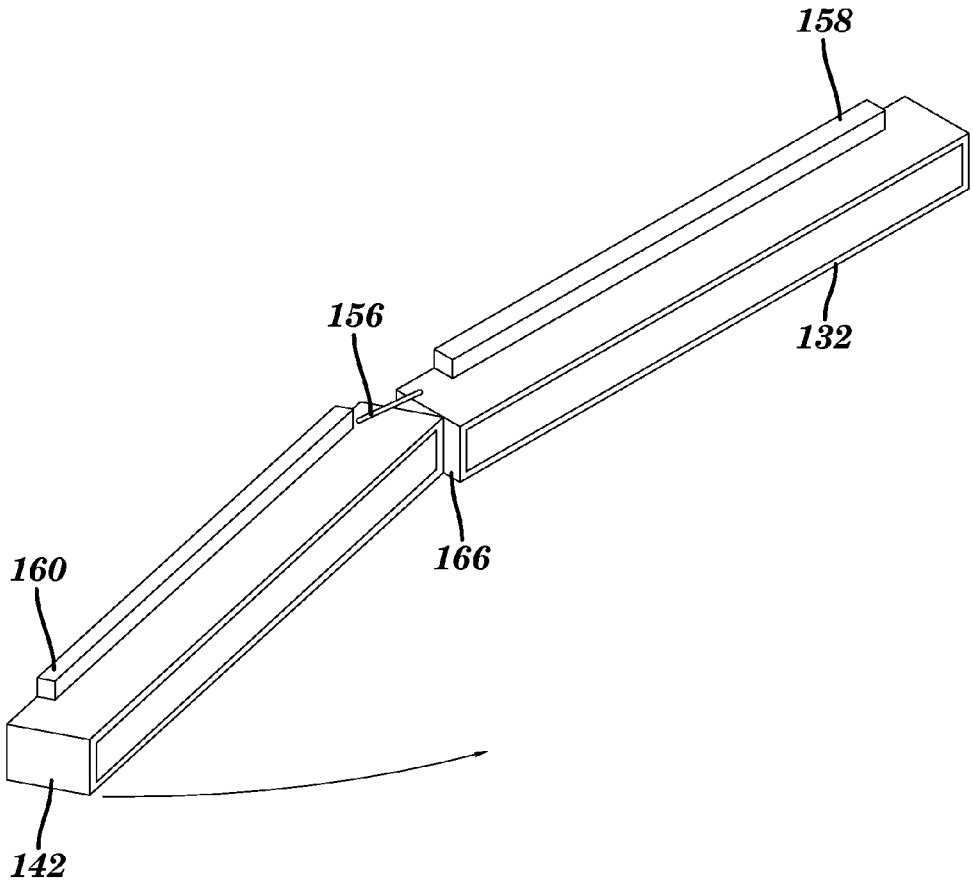
Figure 18K:
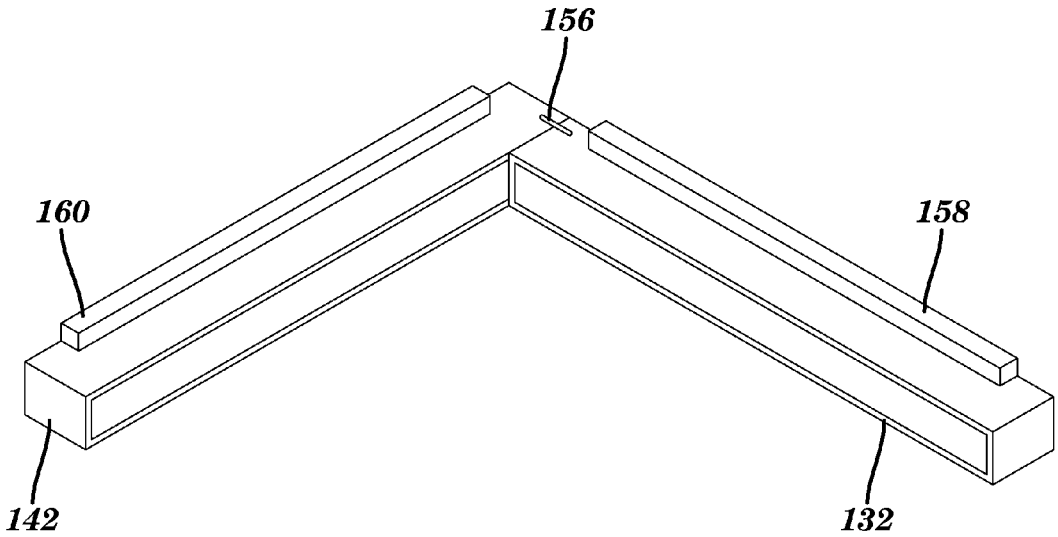
Figure 18L:
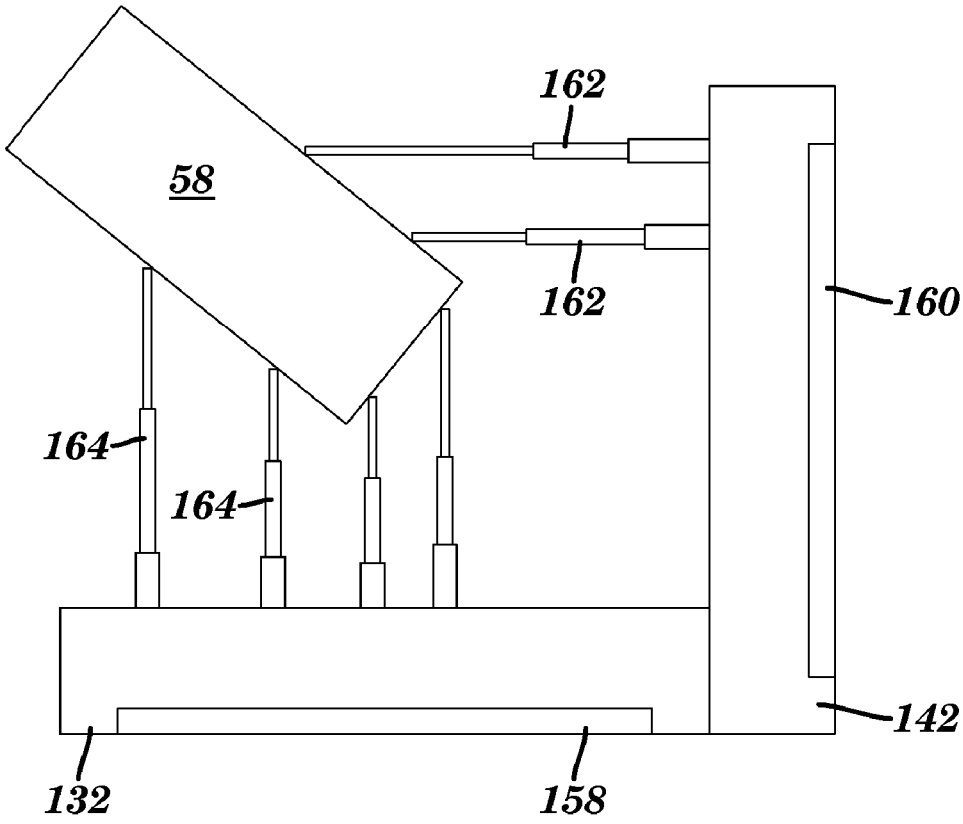
FIG. 18L is a plan view of the embodiment of FIG. 18A.

As shown in the embodiment of FIGS. 18A-18L, bodies 132 and 142 are connected by hinge 156, which allows the tool to be folded, expanded, and reshaped, according to the requirements of a particular job. The bodies 132 and 142 may be folded into a relatively compact closed position with a longitudinal dimension 1, as shown in FIG. 18E. The bodies 132 and 142 may be repositioned to an open position with a larger longitudinal dimension L, as shown in FIG. 18I. The bodies 132 and 142 may be repositioned to an L shape, as shown in FIG. 18L.

As mentioned above, the embodiment of FIGS. 18A-18L includes bodies 132 and 142, which are connected with a hinge 156. Fingers 162 are extendable from body 132, and fingers 164 are extendable from body 142. Handle 158 is disposed on body 132, and handle 160 is disposed on body 142. When this embodiment is in a closed position, handles 158 and 160 may optionally be aligned to function as a single handle. As shown in FIG. 18B, bodies 132, 142 may be held in a closed position with a clasp 154.

In the closed position, face 166 of body 132 is adjacent to face 168 of body 142. (FIG. 18E). Dials 124 may be used to rotate fingers 164 to retracted positions, and dials 114 may be used to rotate fingers 162 to retracted positions, as shown in FIG. 18C. Optionally, dials 114 may also be used to slide fingers 162 to releasably retained adjusted positions along track 126, and dials 124 may be used to slide fingers 164 to releasably retained positions along track 128, as shown in FIG. 18C.

This embodiment may be used in the closed position with a smaller tile, for example as shown in FIG. 18D. In this example, fingers 162 may be extended over a loose tile 52, such as square tile with a dimension of up to 12.0 inches (30.5 cm), as shown in the example of FIG. 18D.

The bodies 132, 142 may be adjusted to an open position when the clasp 154 is opened (FIG. 18B), as shown in FIGS. 18F-18I. Bodies 132 and 142 remain connected by hinge 156 as they are moved to the open position, as shown in FIGS. 18F, 18G. In the open position, face 166 and face 168 are engaged, and bodies 132 and 142 have a longitudinal dimension L, which is larger than l of the closed position. This tool may be used in the open position with a larger tile, for example a square tile with a dimension of up to 24.0 inches (61.0 cm), as shown in FIG. 18H.

As shown in FIGS. 18I-18J, bodies 132, 142 may be adjusted from an open position to an L-shaped position. Hinge 156 connects bodies 132 and 142 as body 142 is repositioned orthogonally to body 132. As shown in FIG. 18L, fingers 162 and 164 extend orthogonally to one another, similarly to fingers 30, 130 of the embodiment of FIGS. 11 and 12. As discussed above in reference to FIGS. 11 and 12, the L-shaped position may be particularly advantageous for use with an irregularly shaped obstruction 58.

Figure 19:
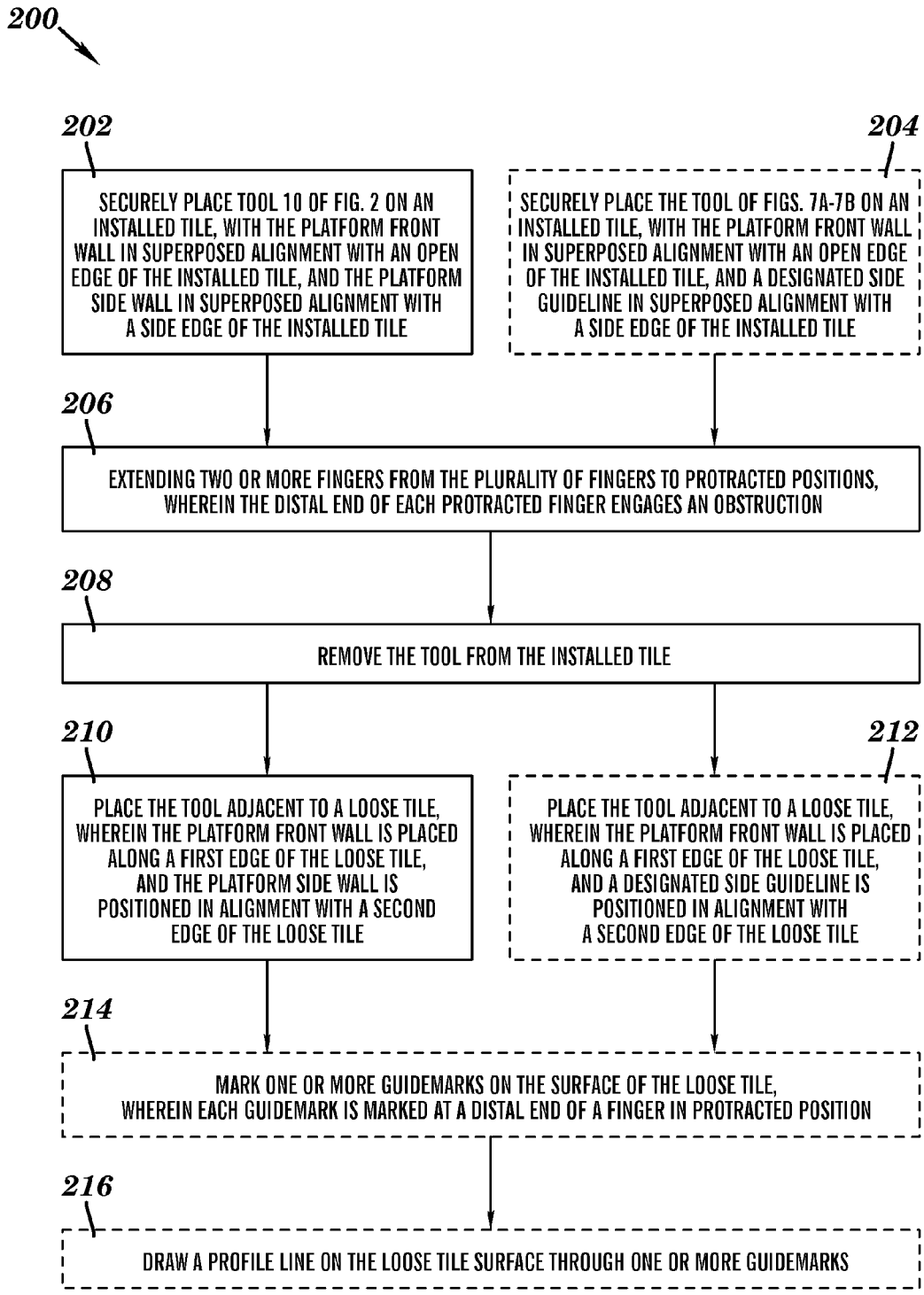
FIG. 19 is a flow chart of a method associated with an embodiment of the invention.

FIG. 19 illustrates a method of use 200 associated with an embodiment of the present invention. In step 202, the tool of FIGS. 1A, 2, and 3 is securely placed on an installed tile, with the platform front wall in superposed alignment with an open edge of the installed tile, and with the platform side wall in superposed alignment with a side edge of the installed tile. Alternatively, in optional Step 204, the tool of FIGS. 7A-7B is securely placed on an installed tile, with the platform front wall in superposed alignment with an open edge of the installed tile, and with a designated sideline in superposed alignment with a side edge of the installed tile.

The platform remains secured on the installed tile until it is removed in Step 208 below. For example, as mentioned above, an embodiment of the tool may comprise anchoring pads to securely anchor the platform to the installed tile.

In Step 206, two or more fingers are extended to protracted positions, wherein the distal end of each protracted finger engages an obstruction. In Step 208, the tool is removed from the installed tile.

In Step 210, the tool is placed adjacent to a loose tile, with the platform front wall placed along a first edge of the loose tile, and with the side wall positioned in alignment with a second edge of the loose tile. Alternatively, in optional step 212, the tool is placed adjacent to a loose tile, with the platform front wall placed along a first edge of the loose tile, and a designated side guideline positioned in alignment with a second edge of the loose tile.

The distal ends of the protracted fingers define dimensions for cutting the loose tile. In some embodiments, as discussed above, configurations of the x and y coordinates of each finger may be stored in memory with a computing element with a memory component. In the embodiment of FIG. 19, the user may optionally mark out the desired cutting dimensions on the surface of the loose tile. For example, in optional Step 214, one or more guidemarks is be marked on the surface of the loose tile. Each guidemark is marked at a distal end of a finger in protracted position. In optional Step 216, a profile line is drawn on the loose tile surface through one or more guidemarks.

Method 200 is an intuitive approach for making two dimensional measurements, without requiring a user to make mathematical calculations. This approach saves time because it results in an accurate two-dimensional measurement, without the trial and error of refining a template tile until it fits the area to be tiled.

Figure 20:
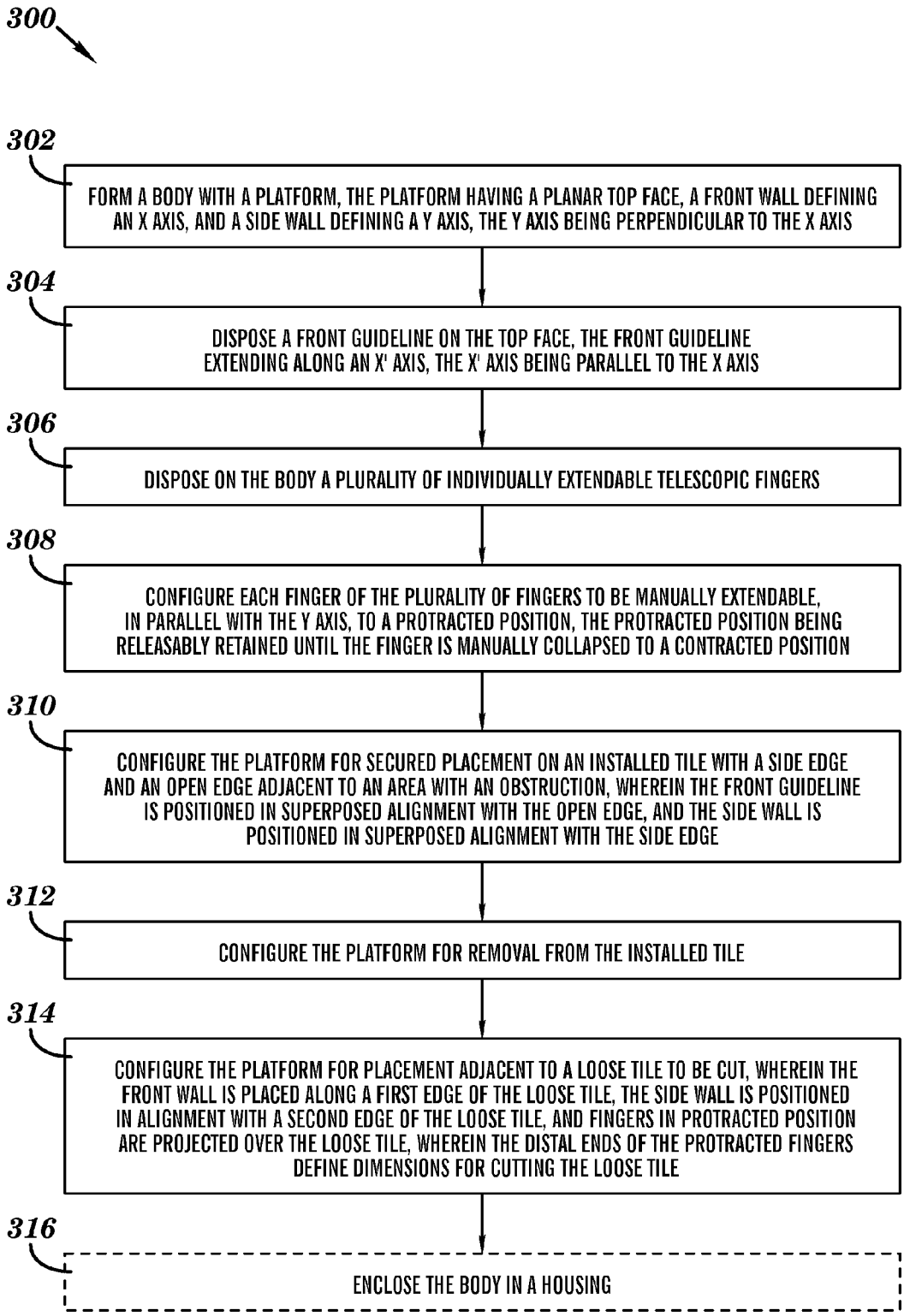
FIG. 20 is a flow chart of another method associated with an embodiment of the invention.

FIG. 20 illustrates a method 300 for manufacturing an embodiment of the present invention. In Step 302, a body is formed with a platform, the platform having a planar top face, a front wall defining an x axis, and a side wall defining a y axis, the y axis being perpendicular to the x axis. For example, forming the body may comprise extruding a polymeric material. In Step 304, a front guideline is disposed on the top face, the front guideline extending along an x' axis, the x' axis being parallel to the x axis.

In Step 306, a plurality of individually extendable telescopic fingers are disposed on the body. In Step 308, each finger of the plurality of fingers is configured to be manually extendable, in parallel with the y axis, to a protracted position. The protracted position may be releasably retained until the finger is manually collapsed to a contracted position. For example, telescoping antennae may be used as fingers.

In Step 310, the platform is configured for secured placement on an installed tile with a side edge and an open edge adjacent to an area with an obstruction, wherein the front guideline is positioned in superposed alignment with the open edge, and the side wall is positioned in superposed alignment with the side edge. In Step 312, the platform is configured for removal from the installed tile.

In Step 314, the platform is configured for placement adjacent to a loose tile to be cut, wherein the front wall is placed along a first edge of the loose tile, the platform side wall is positioned in alignment with a second edge of the loose tile, and fingers in protracted position are projected over the loose tile, wherein the distal ends of the protracted fingers define dimensions for cutting the loose tile. In optional Step 316, the body is enclosed in a housing.

It should be understood that any of the features described with respect to one of the embodiments described herein may be used with any other of the embodiments described herein without departing from the spirit and scope of the present invention.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A tool for marking dimensions for cutting a tile, comprising:

a body comprising a platform with a planar top face, a front wall defining an x axis, and a side wall defining a y axis, the y axis being perpendicular to the x axis;

a front guideline disposed on the top face, the front guideline defining along an x' axis, the x' axis being parallel to the x axis;

the body further comprising a plurality of individually extendable telescopic fingers, wherein each finger of said plurality is located at an x coordinate, the x coordinate being a location on the x axis; each finger comprising a movable distal end positioned at a y coordinate, the y coordinate being a location on the y axis;

each finger in said plurality being manually slidable, in parallel with the x axis, to an adjusted position with a new x coordinate, the adjusted position being releasably retained until the finger is manually slid to a different x coordinate;

each finger of said plurality being manually extendable, in parallel with the y axis, to a protracted position as the distal end is manually pulled to a new y coordinate, the protracted position being releasably retained until the finger is manually collapsed to a contracted position;

each finger being manually rotatable along a z axis to a retracted position, the z axis being orthogonal to both the x axis and the y axis;

the body further comprising a computing element with a processor and a memory storage component, the computing element being configured to store and retrieve data relating to configurations of said plurality of fingers, wherein each configuration includes the x coordinate and the y coordinate of each finger in said plurality;

the body further comprising a user interface configured for user control of the computing element;

said platform being configured for secured placement on an installed tile with a side edge and an open edge adjacent to an area with an obstruction, wherein the front guideline is positioned in superposed alignment with the open edge, and the side wall is positioned in superposed alignment with the side edge;

wherein a selection of at least two fingers from said plurality of fingers are extended to protracted positions, wherein the distal end of each finger in said selection engages the obstruction;

the selection including first and second fingers, said first finger disposed at a x coordinate x1 and y coordinate y1, and said second finger disposed at x coordinate x2 and y coordinate y2;

said platform being further configured for removal from the installed tile and for placement adjacent to a loose tile to be cut, wherein the platform front wall is placed along a first edge of the loose tile, the platform side wall is positioned in alignment with a second edge of the loose tile, and the fingers of said selection are projected over the loose tile;

wherein the first finger distal end defines a point (x1, y1) on the surface of the loose tile for marking a first guidemark, the point (x1, y1) being colinear with the x1 coordinate and the y1 coordinate;

wherein the second finger distal end defines a point (x2, y2) on the surface of the loose tile for marking a second guidemark, the point (x2, y2) being colinear with the x2 coordinate and the y2 coordinate, and wherein the first and second guidemarks demarcate a dimension for cutting the loose tile.

2. A tool for determining dimensions for cutting a tile, comprising:

a body including a platform with a planar top face, a front wall defining an x axis, and a side wall defining a y axis, the y axis being perpendicular to the x axis;

a front guideline disposed on the top face, the front guideline extending along an x' axis, the x' axis being parallel to the x axis;

a plurality of individually extendable telescopic fingers coupled to said body, each finger of said plurality being manually extendable, in parallel with the y axis, to a protracted position, the protracted position being releasably retained until the finger is manually collapsed to a contracted position;

said plurality of fingers being disposed in spaced relation along the x axis, wherein adjacent fingers are configured for being disposed less than one inch (2.5 cm) apart;

said platform being configured for secured placement on an installed tile with a side edge and an open edge adjacent to an area with an obstruction, wherein the front guideline is positioned in superposed alignment with the open edge, and the side wall is positioned in superposed alignment with the side edge;

wherein a selection of fingers, including at least two of said plurality of fingers, are extendable to protracted positions in which a distal end of each finger in said selection is engaged with the obstruction;

said platform being further configured for removal from the installed tile and for placement adjacent to a loose tile to be cut, wherein the front wall is placed along a first edge of the loose tile, the side wall is positioned in alignment with a second edge of the loose tile, and the fingers of the selection are projected over the loose tile;

wherein the distal ends of the fingers of the selection define dimensions for cutting the loose tile.

3. The tool of claim 2, wherein the distal ends of the fingers of the selection indicate points on the surface of the loose tile for marking guidemarks, wherein the guidemarks demarcate dimensions for cutting the loose tile.

4. The tool of claim 2, further comprising a plurality of additional front guidelines disposed on the top face of the platform, said plurality of additional front guidelines extending along a plurality of x' axes, wherein each x' axis is configured for alternative alignment with the open face of the installed tile.

5. The tool of claim 2, further comprising a plurality of side guidelines disposed on the top face of the platform, said plurality of side guidelines extending along a plurality of y' axes in parallel to the y axis, each side guideline of said plurality being usable as an alternative to the side wall for defining an alternative y axis.

6. The tool of claim 2, wherein each finger in said plurality of fingers comprises a digitally engagable knob disposed in proximity of the distal end, the knob being configured for manual extending and collapsing of the finger.

7. The tool of claim 2, further comprising a handle disposed on said body.

8. The tool of claim 2, disposed within a housing having a hinged closure.

9. The tool of claim 2, further comprising an anchoring pad disposed on a bottom face of said platform, the anchoring pad being configured for releasably securing said platform to a surface.

10. The tool of claim 2, wherein each of said plurality of fingers is releasably movable, in parallel with the x axis, to an adjusted x coordinate position.

11. The tool of claim 10, wherein each of said plurality of fingers is connected to a digitally engagable slider knob, said slider knob being configured for the manual movement of the finger in parallel to the x axis.

12. The tool of claim 2, wherein each of said plurality of fingers in contracted position is configured for rotation about a z axis to a retracted position, wherein the z axis is orthogonal to the x axis and the y axis.

13. The tool of claim 12, further comprising a plurality of dials, wherein each of said plurality of dials is configured for said rotation.

14. The tool of claim 2, further comprising a manually movable marking instrument disposed proximate the distal end of a finger of the plurality of fingers, the marking instrument configured for manual marking of the loose tile surface.

15. The tool of claim 2, wherein said body further comprises an other platform extending orthogonally relative to said platform;

said other platform having an other plurality of telescoping fingers, said other plurality being individually extendable in parallel with the x axis.

16. The tool of claim 2, wherein said body further comprises an extendable measuring strip disposed around a reel.

17. The tool of claim 16, said measuring strip comprising a digitally engagable tab configured for manual extension of the strip from the body to an extended position.

18. The tool of claim 17, further comprising a stop for fixing said measuring strip in extended position.

19. The tool of claim 18, further comprising a digitally engagable lever configured for releasably fixing the stop in extended position.

20. The tool of claim 2, said selection of fingers comprising first and second fingers, the distal end of said first finger being disposed at a x coordinate x1, and y coordinate y1, the distal end of said second finger being disposed at x coordinate x2 and y coordinate y2.

21. The tool of claim 20, wherein the coordinates (x1, y1) and (x2, y2) define a notional profile along which the loose tile is to be cut.

22. The tool of claim 2, said body further comprising a computing element with a processor and a memory component.

23. The tool of claim 22, wherein said computing element is configured to store and retrieve data relating to configurations of said plurality of fingers, wherein each configuration includes the x coordinate and the y coordinate of each finger in said plurality.

24. The tool of claim 22, said body further comprising a user interface configured for user control of the computing element.

25. The tool of claim 24, wherein the user interface comprises a display screen.

26. The tool of claim 24, wherein the user interface comprises a coordinate display screen, the coordinate display screen configured to display a y coordinate and optional x coordinate for each finger.

27. The tool of claim 24, wherein the user interface comprises an entry button for storing a configuration.

28. The tool of claim 24, wherein the user interface comprises a retrieval button for retrieving a configuration from memory.

29. The tool of claim 22, wherein said computing element is configured to transmit data stored in memory to an automated computer controlled cutting machine.

30. The tool of claim 22, wherein said memory component is physically removable from said tool.

31. The tool of claim 22, wherein said memory component is configured to be coupled with an automated computer controlled cutting machine.

32. The tool of claim 23, further comprising actuators, said actuators configured to mechanically adjust each finger of said plurality to the corresponding x and y coordinates of a configuration retrieved from memory.

33. The tool of claim 2, further comprising:

an other body defining an other x axis;

said other body comprising an other plurality of telescoping fingers;

a hinge connecting said other body to said body;

said other body being configured for placement in a closed position relative to said body;

wherein the x axes of said body and said other body are superposed;

said other body being configured for placement in an open position relative to said body; wherein the x axes of said body and said other body are coaxial; and said other body being configured for placement in an L-shaped position relative to said body; wherein the x axes are orthogonal.

34. The tool of claim 33, further comprising a clasp configured to releasably lock the body and other body in the closed position.

35. The tool of claim 34, wherein said other body further comprises a handle.

36. The tool of claim 10, comprising a sliding mechanism captured within the body, the sliding mechanism being configured for enabling releasable movement of each of the plurality of fingers parallel with the x axis, to an adjusted x coordinate position.

37. The tool of claim 10, wherein each of the plurality of fingers is movable along the x axis by friction fit.

38. A tool for determining dimensions for cutting a tile, comprising:

a body including a platform with a planar top face, a front wall defining an x axis, and a side wall defining a y axis, the y axis being perpendicular to the x axis;

a front guideline disposed on the top face, the front guideline extending along an x' axis, the x' axis being parallel to the x axis;

a plurality of individually extendable telescopic fingers coupled to said body, each finger of said plurality being manually extendable, in parallel with the y axis, to a protracted position, the protracted position being releasably retained until the finger is manually collapsed to a contracted position;

each of the fingers including a digitally engagable knob disposed in proximate, spaced relation from the distal end, the knob extending orthogonally from the finger and being configured for manually extending and collapsing the finger;

a marking instrument disposed on each of the fingers, proximate the distal end thereof, the marking instrument configured for marking of the loose tile surface;

a closure movably coupled to the body, the closure being movable between a closed position configured to cover the fingers when the fingers are disposed in their contracted positions, and an open position configured to uncover the fingers and permit the fingers to be moved to their protracted positions;

said platform being configured for secured placement on an installed tile with a side edge and an open edge adjacent to an area with an obstruction, wherein the front guideline is positioned in superposed alignment with the open edge, and the side wall is positioned in superposed alignment with the side edge;

wherein a selection of fingers, including at least two of said plurality of fingers, are extendable to protracted positions in which a distal end of each finger in said selection is engaged with the obstruction;

said platform being further configured for removal from the installed tile and for placement adjacent to a loose tile to be cut, wherein the front wall is placed along a first edge of the loose tile, the side wall is positioned in alignment with a second edge of the loose tile, and the fingers of the selection are projected over the loose tile;

wherein the distal ends of the fingers of the selection define dimensions for cutting the loose tile.

* * * * *